US007448244B2

(12) United States Patent
Aoe et al.

(10) Patent No.: US 7,448,244 B2
(45) Date of Patent: Nov. 11, 2008

(54) PROCESS FOR PRODUCING HOT-ROLLED STEEL STRIP AND APPARATUS THEREFOR

(75) Inventors: Shinichiro Aoe, Kawasaki (JP); Masaki Kobayashi, Tokyo (JP); Hiromasa Hayashi, Kawasaki (JP); Daijiro Yuasa, Tokyo (JP); Masaji Tomiyama, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 486 days.

(21) Appl. No.: 10/517,170

(22) PCT Filed: Aug. 20, 2003

(86) PCT No.: PCT/JP03/10511

§ 371 (c)(1),
(2), (4) Date: Aug. 22, 2005

(87) PCT Pub. No.: WO2004/020120

PCT Pub. Date: Mar. 11, 2004

(65) Prior Publication Data

US 2006/0010951 A1 Jan. 19, 2006

(30) Foreign Application Priority Data

| | | |
|---|---|---|
| Aug. 27, 2002 | (JP) | 2002-247462 |
| Mar. 5, 2003 | (JP) | 2003-059120 |
| Mar. 19, 2003 | (JP) | 2003-075121 |
| May 26, 2003 | (JP) | 2003-147108 |

(51) Int. Cl.
*B21B 27/06* (2006.01)

(52) U.S. Cl. ..... 72/201; 72/236; 72/342.2

(58) Field of Classification Search ..... 266/46, 266/113; 72/200, 201, 202, 236, 342.2, 365.2
See application file for complete search history.

(56) References Cited

U.S. PATENT DOCUMENTS 3,151,197 A * 9/1964 Schultz ..... 266/102

(Continued)

FOREIGN PATENT DOCUMENTS

JP 50-7762 A 1/1975

(Continued)

*Primary Examiner*—Edward Tolan
(74) *Attorney, Agent, or Firm*—Frishauf, Holtz, Goodman & Chick, P.C.

(57) ABSTRACT

The present invention relates to a production method for a hot rolled strip in a hot rolling line. An object of the present invention is to ensure stable running of a hot rolled strip on a hot runout table, and to prevent excessive displacement of the hot rolled strip above a pass line, and, for example, a head folding defect and a tail folding defect resulting from the displacement. In the method of the present invention, a fluid jet is squirted above a hot rolled strip conveyed by a hot runout table so as to pass over the hot rolled strip running without touching a surface of the hot rolled strip running on a pass line (a strip-conveying surface of the hot runout table). A strip portion displaced upward from the pass line beyond a predetermined level collides with the fluid jet, and the displacement of the strip portion is thereby corrected. Since the fluid jet passes over the normally running hot rolled strip without touching therewith, the strip portion is properly prevented from being displaced by squirting the fluid jet.

32 Claims, 23 Drawing Sheets

U.S. PATENT DOCUMENTS 3,230,752 A * 1/1966 Dobson et al. ..... 72/202
3,420,083 A * 1/1969 Safford et al. ..... 72/201
4,497,180 A * 2/1985 Graham ..... 62/63
5,701,775 A * 12/1997 Sivilotti et al. ..... 72/201
6,295,852 B1 * 10/2001 Kipping et al. ..... 72/39
6,733,720 B2 * 5/2004 Fujibayashi et al. ..... 266/46

FOREIGN PATENT DOCUMENTS

JP 9-192717 A 7/1997
JP 11-267732 A 10/1999
JP 2001-340911 A 12/2001

* cited by examiner

PROCESS FOR PRODUCING HOT-ROLLED STEEL STRIP AND APPARATUS THEREFOR

This application is a U.S. National Phase Application under 35 USC 371 of International Application PCT/JP2003/010511 filed Aug. 20, 2003.

TECHNICAL FIELD

The present invention relates to a production method and production system for a hot rolled strip in a hot rolling line. More particularly, the present invention relates to a method and system that smoothly conveys on a hot runout table a hot rolled strip rolled by a hot finishing rolling mill. Jumping or waving of the hot rolled strip on the hot runout table is eliminated by squirting water in a characteristic manner.

BACKGROUND ART

In a typical hot rolling line for producing hot rolled strips, a hot steel slab is rolled into a hot rolled strip by a hot rolling train including a hot roughing rolling mill and a hot finishing rolling mill, and the hot rolled strip is cooled by cooling water while running on a hot runout table composed of a plurality of table rolls, and is then coiled with a coiler, thus obtaining a hot rolled strip coil.

In the hot rolling line, the hot rolled strip runs on the hot runout table in an unstable state on free tension from when the head end of the hot rolled strip passes through the hot rolling train and until when the head end is coiled with the coiler. Therefore, a phenomenon in which the head end of the strip lifts from a hot runout table 50 (pass line) (hereinafter referred to as "jumping") 51*a* tends to occur, as shown in FIG. 32(*i*). When the jumping 51*a* becomes excessively large, a phenomenon in which the head end of the strip is folded in a direction opposite to the strip running direction (hereinafter referred to as a "head folding defect") 52*a* occurs, as shown in FIG. 32(*ii*).

While the head end of the hot rolled strip similarly runs on the hot runout table 50 on free tension, when the strip running velocity on the downstream side becomes lower than the strip running velocity on the upstream side for some reason (for example, by the influence of cooling water supplied from above), a phenomenon in which the hot rolled strip waves (hereinafter referred to as "waving") 53*a* occurs, as shown in FIG. 33(*i*). When the waving 53*a* increases in size, a phenomenon in which the waving portion is folded in the direction opposite to the strip running direction (hereinafter referred to as a "strip folding defect") 54*a* occurs, as shown in FIG. 33(*ii*).

From when the head end of the hot rolled strip is wound on the coiler and until when the tail end of the hot rolled strip passes through the hot rolling train, the hot rolled strip runs on the hot runout table in a tensioned state. Therefore, unordinary displacement, such as the above-described waving, will not occur. However, after the tail end of the hot rolled strip passes through the hot rolling train, the hot rolled strip runs again on the hot runout table in an unstable state on free tension. As shown in FIG. 34(*i*), jumping 51*b* occurs and the tail end of the strip moves up and down in a waving form. When the jumping 51*b* excessively increases in sizes, a phenomenon in which the tail end of the strip is folded in the strip running direction (hereinafter referred to as a "tail folding defect) 52*b* occurs, as shown in FIG. 34(*ii*). In a manner similar to that in the above-described waving that occurs at the head end of the strip, when the strip running velocity on the downstream side becomes lower than the strip running velocity on the upstream side for some reason, waving 53*b* also occurs at the tail end of the strip, as shown in FIG. 35(*i*). When the waving 53*b* increases in size, a strip folding defect 54*b* is caused, as shown in FIG. 35(*ii*).

Recently, the thickness of hot rolled strips has been increasingly reduced according to user demands. On the other hand, the running velocity tends to increase in order to ensure high productivity. The probability that the above-described unordinary displacement (unstable phenomenon), such as jumping or waving, of hot rolled strips on the hot runout table will occur increases as the thickness of the hot rolled strips decreases and as the running velocity increases.

When the jumping 51*a* and the head folding defect 52*a* described above occur at the head end of a hot rolled strip, the head end cannot enter between pinch rolls on the upstream side of the coiler, and the hot rolled strip cannot be coiled with the coiler. Moreover, the pinch rolls and the peripheral instruments including the coiler may be damaged by the impact made when a strip portion with the jumping 51*a* or the head folding defect 52*a* collides therewith. Even if the hot rolled strip can be coiled with the coiler, a strip portion that is not smoothly wound, that is, a strip portion having the head folding defect 52*a* or scratches must be removed by cutting in the next process. This pronouncedly lowers the production yield.

When the jumping 51*b* or the tail folding defect 52*b* occurs at the tail end of the hot rolled strip, it is difficult to neatly wind the tail end on the coiler. Furthermore, the components of the hot runout table may be damaged depending on the degree of the jumping 51*b* and the tail folding defect 52*b* (the condition of jumping or waving). For example, spliters of the hot rolled strip produced in such a case sometimes fall on the hot rolled strip, and make scratches thereon. In this case, even if the hot rolled strip can be coiled with the coiler, a strip portion that is not smoothly wound, that is, a strip portion having the tail folding defect 52*b* or scratches must be removed by cutting in the next process. This lowers the production yield.

When the waving 53*a* and 53*b* and the strip folding defects 54*a* and 54*b* occur at the head end and tail end of the hot rolled strip, coiling of the strip may be hindered and the instruments may be damaged, in a manner similar to that in the case in which the jumping 51*a* and 51*b*, the head folding defect 52*a*, and the tail folding defect 52*b* occur. Since cooling on the hot runout table by cooling water is not uniform in the longitudinal direction of the hot rolled strip, the material of the hot rolled strip is uneven. As a result, a strip portion having the strip folding defects 54*a* and 54*b* and the strip portion having quality variations must be removed by cutting, and this pronouncedly lowers the production yield.

As described above, in the production of hot rolled strips, it is quite important, for high productivity and high quality of the hot rolled strips, to cause the hot rolled strips to stably run on the hot runout table by preventing unordinary displacement (unstable running phenomenon).

The above-described unordinary displacement (unstable running phenomenon) of the strips can be reduced to some extent by decreasing the line velocity. However, the reduction in line velocity lowers the productivity of the hot rolled strips. Moreover, since high quality of the strips cannot be ensured, for example, the finishing temperature cannot be ensured, it is difficult to adopt this method.

In order to ensure running stability of hot rolled strips on the hot runout table, the following proposals have been submitted:

(1) Jumping at the head end of a hot rolled strip running on the hot runout table is pushed by spraying horizontal or oblique jets of gas or liquid from nozzles. (Document 1: Japanese Examined Patent Application Publication No. 52-30137)

(2) Water is directly sprayed onto the surface of a hot rolled strip, which is running on the hot runout table, in an obliquely upward direction by spray devices on the upstream side of the hot runout table, and a velocity component of the sprayed water in the strip running direction is set to be higher than the running velocity of the hot rolled strip so that a thrust acts on the hot rolled strip. This prevents jumping or waving at the head end of the hot rolled strip. (Document 2: Japanese Unexamined Patent Application Publication No. 10-118709).

(3) When the head end of a hot rolled strip runs on the hot runout table, water is horizontally sprayed at an angle of approximately 5° to 30° to the strip running direction from spray devices disposed by the side of the hot runout table, thereby preventing jumping that causes a head folding defect at the head end of the hot rolled strip. (Document 3: Japanese Unexamined Patent Application Publication No. 2001-340911).

(4) While the tail end of a hot rolled strip runs on the hot runout table, high-pressure water is directly sprayed onto the surface of the hot rolled strip in the direction opposite to the strip running direction, thereby preventing waving at the tail end. (Document 4: Japanese Unexamined Patent Application Publication No. 11-267732, Document 5: Japanese Unexamined Patent Application Publication No. 2002-192214)

DISCLOSURE OF THE INVENTION

However, according to the examinations, the present inventors found that the above conventional methods have the following problems:

(A) In the conventional methods disclosed in Documents 2, 4, and 5, fluid, such as water, is directly sprayed in an obliquely upward direction onto the surface of a hot rolled strip that is running on a pass line of a hot runout table. In Document 1, an oblique jet is similarly sprayed onto the strip surface. However, when the fluid is directly sprayed onto the surface of the strip on the pass line in an obliquely upward direction, as in these conventional methods, since the fluid has a vertical velocity component, it applies a vertical impact force to the hot rolled strip that is normally running on the pass line of the hot runout table. The impact force acts so as to push the strip between adjacent table rolls of a hot runout table 50, as shown in FIG. 36(*i*). As a result, jumping 55 occurs at the head end of the strip, as shown in FIG. 36(*ii*), and finally leads to a head folding defect 52*a*, as shown in FIG. 32(*ii*). Such jumping 55 similarly occurs at the tail end of the strip, and finally leads to a tail folding defect 52*b*, as in FIG. 34(*ii*). The action in which the strip is pushed between the table rolls by the vertical velocity component of the fluid causes waving at the head end and tail end of the strip, and waving finally leads to strip folding defects 54*a* and 54*b*, as shown in FIGS. 33(*ii*) and 35(*ii*).

For example, when the jumping 51*a* at the head end of the strip shown in FIG. 32(*i*) is relatively small, it can be eliminated by collision with the fluid, as shown in FIG. 37A. However, when the fluid collides with jumping 51*a* that has increased in size, as shown in FIG. 37B, the jumping 51*a* cannot be sufficiently suppressed, and there is a high possibility that the jumping 51*a* will lead to a head folding defect 52*a*, as shown in FIG. 32(*ii*). When the fluid collides with the waving 53*a* at the head end of the strip shown in FIG. 33(*i*), the jumping 51*b* at the tail end of the strip shown in FIG. 34(*i*), and the waving 53*b* at the tail end of the strip shown in FIG. 35(*i*), there is also a high possibility that they will lead to a strip folding defect 54*a*, a tail folding defect 52*b*, and a strip folding defect 54*b*.

(B) In the conventional method disclosed in Document 3, fluid is horizontally sprayed onto the head end of the strip. In Document 1, a horizontal flow is similarly sprayed. Initially, the present inventors considered that spraying of a horizontal flow did not cause the problems described in the above (A) that were caused by directly spraying the fluid onto the strip surface in an obliquely upward direction. After further investigations, however, it was found that problems substantially similar to those in the above (A) arose in these conventional methods.

That is, these conventional methods aim to press jumping by horizontally spraying fluid onto the jumping head end of the strip. In actuality, it is impossible to spray the fluid onto the jumping head end of the strip when only the jumping head end runs. Of course, the fluid is also sprayed while the strip is normally running on the pass line. In this case, after the fluid is jetted, a part of or the entirety of the fluid decreases in velocity, and lands on the surface of the strip that is normally running on the pass line. Since the fluid landing on the strip surface, of course, applies a vertical impact force on the hot rolled strip, problems substantially similar to those described in the above (A) occur. Document 3 mentions that the fluid does not touch the strip surface because it is horizontally sprayed, and therefore, the head end of the strip will not enter between the table rolls, and also mentions operational functions different from those in the method in which the fluid is directly sprayed onto the strip surface in an obliquely upward direction, as in Document 2. However, it was found that the above-described problems also arose in the method in Document 3 in which the fluid is not directly sprayed onto the strip surface.

The present inventors found that it was essential to squirt a beam-shaped fluid jet so as to completely pass over a hot rolled strip in order to overcome these problems, and completed the present invention. The found facts will be described in detail below. The above documents do not suggest these found facts and method. That is, the method disclosed in Document 1 includes a method for directly spraying fluid onto the strip surface in an obliquely upward direction, as described in the above (A). The operational function of fluid spraying disclosed in the document is merely to produce air flow in the strip running direction by fluid spraying and to prevent jumping of the head end of the strip by the air flow. Therefore, Document 1 does not disclose a technical idea in which a beam-shaped fluid jet is squirted so as to completely pass over a hot rolled strip. Document 3 mentions the above-described operational function of horizontally spraying fluid. However, FIG. 1 of Document 3 shows the water sprayed in a cone-spray form, and does not disclose the technical idea in which a beam-shaped fluid jet is squirted so as to completely pass over the hot rolled strip.

The present invention has been made to overcome the above-described problems of the conventional techniques. An object of the present invention is to effectively suppress excessive displacement (for example, jumping or waving) of a hot rolled strip, which runs on a hot runout table, above a pass line by squirting fluid and to reliably prevent a head folding defect, a tail folding defect, and a strip folding defect of the hot rolled strip resulting from the displacement. Another object is to properly prevent a portion of the strip from being displaced above the pass line by the fluid squirting. A further object is to provide a production method and a production system for a hot rolled strip that can reliably achieve stable running of a hot rolled strip on a hot runout able.

In view of the above-described problems of the conventional methods, the present inventors examined a method for effectively suppressing excessive displacement of a hot rolled strip, which runs on a hot runout table, above a pass line by squirting fluid, and as a result, found the following:

(a) In order to achieve stable running of a hot rolled strip on a hot runout table by squirting fluid, it is essential to squirt a beam-shaped fluid jet so as to completely pass over the hot rolled strip without touching a surface of the hot rolled strip normally running on the pass line. This can effectively suppress excessive displacement (for example, jumping or waving) of the hot rolled strip above the pass line, and can properly prevent a portion of the strip from being displaced above the pass line by the squirting of fluid itself.

(b) In order to particularly effectively suppress excessive displacement (for example, jumping or waving) of the strip above the pass line, it is necessary to optimize the height of the beam-shaped fluid jet passing over the strip from the pass line in the above (a).

That is, when the height of the fluid jet passing above the strip from the pass line is too large, a strip portion displaced above the pass line does not substantially collide with the fluid jet, and therefore, the action of the fluid jet is hardly effective for the displacement of the strip. Even when the height of the fluid jet from the pass line is a height that allows the fluid jet to collide with the displaced strip portion, a phenomenon in which the displaced strip portion sticks to the lower side of the fluid jet sometimes occurs. This phenomenon sometimes reduces running stability, and causes, for example, a head folding defect, a tail folding defect, and a strip folding defect. In contrast, when the height of the fluid jet passing above the strip from the pass line is too small, an impact force of the fluid jet acts on a strip that normally runs (including a strip with a displacement that does not need to be corrected), and running stability is thereby reduced.

(c) In a manner similar to that in the above (b), in order to particularly effectively suppress excessive displacement (for example, jumping or waving) of the strip above the pass line, it is necessary to optimize the thrust (impact force) of the fluid jet passing above the hot rolled strip in the longitudinal direction of the pass line.

That is, when the thrust is too strong, the strip substantially jumps or waves by the reaction of collision with the fluid jet, and the displacement of the strip portion is promoted. In contrast, when the thrust is too weak, the displacement of the strip is not corrected sufficiently.

The present invention has been made based on the above findings. In summary, the present invention provides a hot-rolled-strip production method wherein a hot rolled strip obtained by rolling with a hot rolling mill is conveyed by a hot runout table, and is coiled with a coiler. The production method includes the steps of squirting a fluid jet above the hot rolled strip conveyed by the hot runout table so as to pass over the hot rolled strip without touching a surface of the hot rolled strip running on a pass line (strip-conveying surface of the hot runout table); and causing a portion of the strip displaced upward from the pass line beyond a predetermined level to collide with the fluid jet in order to correct the displacement of the portion.

According to this production method of the present invention, it is possible to effectively suppress excessive displacement (jumping or waving) of a hot rolled strip, which runs on the hot runout table, above the pass line by squirting fluid, and to reliably prevent a head folding defect, a tail folding defect, and a strip folding defect resulting from the displacement. Since the fluid jet completely passes over the hot rolled strip that is normally running without touching the hot rolled strip, displacement of a strip portion above the pass line due to the squirting of fluid can be properly prevented. Consequently, stable running of the hot rolled strip on the hot runout table can be reliably achieved.

In the production method of the present invention, in order to particularly effectively suppress excessive displacement (jumping or waving) of the strip above the pass line, it is preferable to optimize the height of the beam-shaped fluid jet from the pass line when passing above the strip, as described above in the findings on which the present invention is based. More specifically, it is preferable that the height of a center line of the fluid jet passing above the hot rolled strip, from the pass line be more than or equal to 50 mm and less than or equal to 450 mm, more preferably, more than or equal to 50 mm and less than 200 mm.

Similarly, in order to particularly effectively suppress excessive displacement (for example, jumping or waving) of the strip above the pass line, it is preferable to optimize the thrust (impact force) in the longitudinal direction of the pass line of the fluid jet that is passing above the hot rolled strip, as described above in the findings on which the present invention is based. More specifically, it is preferable that the line-direction thrust $F_L$ of the fluid jet passing above the hot rolled strip be defined by the following equation (1), and be set to be within the range of 10 kgf to 50 kgf:

$$F_L=[\rho A(v\cos(\pi\times\alpha/180)-u)^2]/9.8 \quad (1)$$

wherein

ρ: the density of fluid that forms the fluid jet (kg/m$^3$)

A: the cross-sectional area of the aperture of a fluid squirting nozzle (m$^2$)

v: the velocity of the fluid jet (m/sec)

u: the running velocity of the hot rolled strip (m/sec)

α: the angle of the squirting direction of the fluid jet with respect to the strip running direction (°)

In the production method of the present invention, the fluid jet may be squirted in any of the following ways (1) and (2). Therefore, both ways may be used in one line.

(1) The fluid jet is squirted at an angle α to a strip running direction, and the angle α satisfies the condition $0°\leqq\alpha<90°$.

(2) The fluid jet is squirted at an angle α to a direction opposite from a strip running direction (hereinafter referred to as a "counter running direction"), and the angle α satisfies the condition $0°\leqq\alpha<90°$.

When the fluid jet is squirted in the direction in the above (1), it is preferable that a velocity component in the pass-line longitudinal direction of the fluid jet that is passing above the hot rolled strip be higher than the running velocity of the hot rolled strip. It is particularly preferable that a velocity component in the pass-line longitudinal direction of the fluid jet that is passing above the head end of the hot rolled strip be higher than the running velocity of the hot rolled strip, and that a velocity component in the pass-line longitudinal direction of the fluid jet that is passing above the tail end of the hot rolled strip be lower than the running velocity of the hot rolled strip. These conditions allow the fluid jet to properly act on a strip portion displaced above the pass line.

When the above (1) and (2) are both used, it is preferable that the fluid jet be squirted at the head end of the hot rolled strip so that the angle α to the strip running direction satisfies the condition $0°\leqq\alpha<90°$, and that the fluid jet be squirted at the tail end of the hot rolled strip so that the angle $\alpha$ to the counter running direction satisfies the condition $0° \leqq \alpha < 90°$.

It is difficult to precisely predict the position in the longitudinal direction of the hot runout table at which a strip portion is displaced above the pass line. Therefore, preferably, squirting of the fluid jet is performed at a plurality of positions appropriately spaced in the longitudinal direction of the hot runout table. In this case, it is preferable to set the interval between the fluid-jet squirting positions in the longitudinal direction of the hot runout table within the range of 5 m to 15 m.

When the fluid jet is allowed to completely pass over the hot rolled strip in the widthwise direction by setting the angle $\alpha$ of the squirting direction of the fluid jet with respect to the strip running direction or the counter running direction so as to satisfy the condition $0° \leqq \alpha < 90°$, it is preferable that regions in which the fluid jet passes above the strip be consecutively provided in the longitudinal direction of the strip, in order to cope with the displacement of a strip portion above the pass line caused at any position in the longitudinal direction of the hot runout table. For that purpose, preferably, squirting of the fluid jet is performed at a plurality of positions appropriately spaced in the longitudinal direction of the hot runout table, imaginary jet pass lines x are obtained by projecting, onto the surface of the hot rolled strip, the paths of fluid jets that completely pass over the hot rolled strip in the widthwise direction, and ends of jet pass lines x and x adjacent in the pass-line longitudinal direction, of the imaginary jet pass lines x, correspond or overlap with each other in the pass-line longitudinal direction.

When fluid jets are squirted from both widthwise sides of the hot runout table, in order to prevent running of the strip from becoming unstable by the thrust in the strip widthwise direction applied to the strip by the collision of the fluid jets, it is preferable that the fluid jets be squirted at positions opposing across the hot runout table (including positions that are asymmetrically provided with respect to the hot runout table), and that the fluid jets passing over the hot rolled strip be substantially equal in the widthwise thrust $F_W$ defined by the following equation (2):

$$F_W = [\rho A (v \sin(\pi \times \alpha / 180))^2] / 9.8 \quad (2)$$

wherein $\rho$: the density of the fluid that forms the fluid jet ($kg/m^3$)

A: the cross-sectional area of the aperture of the fluid squirting nozzle ($m^2$)

v: the velocity of the fluid jet (m/sec)

$\alpha$: the angle of the squirting direction of the fluid jets with respect to the pass-line longitudinal direction strip running direction or counter running direction (°)

The fluid jet may pass above the hot rolled strip in the longitudinal direction of the pass line instead of completely passing over the hot rolled strip in the widthwise direction. In this case, the fluid jet is collected above the hot rolled strip on the downstream side in the squirting direction of the fluid jets.

While the squirting direction of the fluid jet may be inclined upward or downward with respect to the horizontal plane, it is preferable that the inclination angle $\beta$ of the squirting direction of the fluid jet with respect to the horizontal plane be 10° or less.

In general, a hot rolled strip running on the hot runout table is cooled by cooling water supplied from above. In order to prevent the flow velocity of the fluid jet from being decreased by the cooling water, it is preferable that a shield for shielding the fluid jet from the cooling water be provided above the fluid jet. The shield may be formed of a shielding member provided above the fluid jet, or a shielding fluid jet that flows substantially parallel to and above the fluid jet.

A hot-rolled-strip production system of the present invention is suited to carry out the above-described production method of the present invention, and the abstract thereof is as follows:

[1] A hot-rolled-strip production system includes a hot rolling train, a hot runout table provided on an exit side of the hot rolling train to convey a hot rolled strip, and a coiler for coiling the hot rolled strip conveyed by the hot runout table. A fluid-squirting nozzle is provided by the side of or above the hot runout table to squirt a fluid jet above the hot rolled strip conveyed by the hot runout table so that the fluid jet passes over the hot rolled strip without touching a surface of the hot rolled strip running on a pass line (a strip-conveying surface of the hot runout table), and the height of the center of a nozzle aperture of the fluid-squirting nozzle from the pass line is within the range of 50 mm to 450 mm.

In order to carry out the above-described various production methods, the production system may have the following features [2] to [13]. The significance and advantages of these system features correspond to the above-described production methods.

[2] A hot-rolled-strip production system described in the above [1], wherein the height of the center of the nozzle aperture of the fluid-squirting nozzle from the pass line is more than or equal to 50 mm and less than 200 mm.

[3] A hot-rolled-strip production system described in the above [1] or [2], wherein the angle $\alpha$ of a squirting direction of the fluid jet from the fluid-squirting nozzle with respect to a strip running direction satisfies the condition $0° \leqq \alpha < 90°$.

[4] A hot-rolled-strip production system described in the above [1] or [2], wherein the angle $\alpha$ of a squirting direction of the fluid jet from the fluid-squirting nozzle with respect to a counter running direction satisfies the condition $0° \leqq \alpha < 90°$.

[5] A hot-rolled-strip production system described in the above [1] or [2], wherein the fluid-squirting nozzle includes a fluid-squirting nozzle that allows the angle $\alpha$ of the direction of squirting the fluid jet with respect to a strip running direction to satisfy the condition $0° \leqq \alpha < 90°$, and a fluid-squirting nozzle that allows the angle $\alpha$ of a direction of squirting of the fluid jet from the fluid-squirting nozzle with respect to a counter running direction to satisfy the condition $0° \leqq \alpha < 90°$.

[6] A hot-rolled-strip production system described in any of the above [1] to [5], wherein the fluid-squirting nozzle includes a plurality of fluid-squirting nozzles appropriately spaced in the longitudinal direction of the hot runout table.

[7] A hot-rolled-strip production system described in the above [6], wherein the interval between the fluid-squirting nozzles in the longitudinal direction of the hot runout table is within the range of 5 m to 15 m.

[8] A hot-rolled-strip production system described in any of the above [1] to [7], wherein the angle $\alpha$ of a squirting direction of the fluid jet from the fluid-squirting nozzle with respect to a strip running direction or a counter running direction satisfies the condition $0° \leqq \alpha < 90°$, and the fluid jet squirted from the fluid-squirting nozzle completely passes over the hot rolled strip in the widthwise direction.

[9] A hot-rolled-strip production system described in the above [8], wherein the fluid-squirting nozzle includes a plurality of fluid-squirting nozzles appropriately spaced in the longitudinal direction of the hot runout table, the interval and the squirting direction of the fluid-squirting nozzles are determined so that ends of jet pass lines x and x adjacent in the longitudinal direction of the pass line, of imaginary jet pass lines x obtained by projecting the paths of fluid jets squirted from the fluid-squirting nozzles so as to completely pass over the hot rolled strip in the widthwise direction onto the surface of the hot rolled strip, correspond or overlap with each other in the pass-line longitudinal direction.

[10] A hot-rolled-strip production system described in any of the above [1] to [7], wherein the fluid-squirting nozzle is provided above the pass line so that the squirted fluid jet passes above the hot rolled strip in the longitudinal direction of the pass line, and a collecting means for collecting the fluid jet is provided above the pass line on the downstream side in the squirting direction of the fluid jet.

[11] A hot-rolled-strip production system described in any of the above [1] to [10], wherein a squirting direction of the fluid jet from the fluid-squirting nozzle is inclined upward or downward with respect to a horizontal plane, and the inclination angle β of the squirting direction with respect to the horizontal plane is 10° or less.

[12] A hot-rolled-strip production system described in any of the above [1] to [10], further including a cooling device for supplying cooling water from above to the hot rolled strip conveyed by the hot runout table, and a shielding member provided above the hot runout table to shield the fluid jet squirted from the fluid-squirting nozzle from the cooling water.

[13] A hot-rolled-strip production system described in any of the above [1] to [10], further including a cooling device for supplying cooling water from above to the hot rolled strip conveyed by the hot runout table, and a shielding-fluid-jet squirting nozzle that squirts, above and substantially parallel to the fluid jet squirted from the fluid-squirting nozzle, a shielding fluid jet for shielding the fluid jet from the cooling water.

BEST MODE FOR CARRYING OUT THE INVENTION

The present invention relates to a hot-rolled-strip production method in which a hot rolled strip obtained by rolling with a hot rolling mill is conveyed by a hot runout table and is then coiled with a coiler. The method is characterized in a manner in which a fluid jet is squirted in order to correct (suppress, eliminate) the displacement of the hot rolled strip running on the hot runout table above a pass line (for example, jumping or waving at a head or tail end of the strip, the same applies hereinafter).

Figure 1:
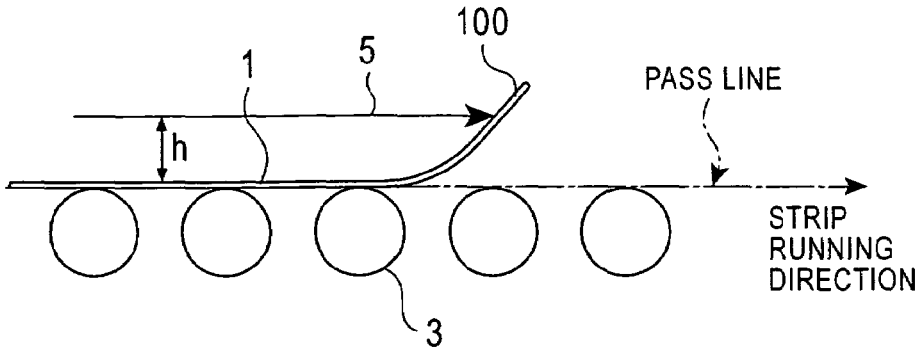
FIG. 1 is a side view showing a fluid-jet squirting manner in a production method of the present invention.
Figure 2:
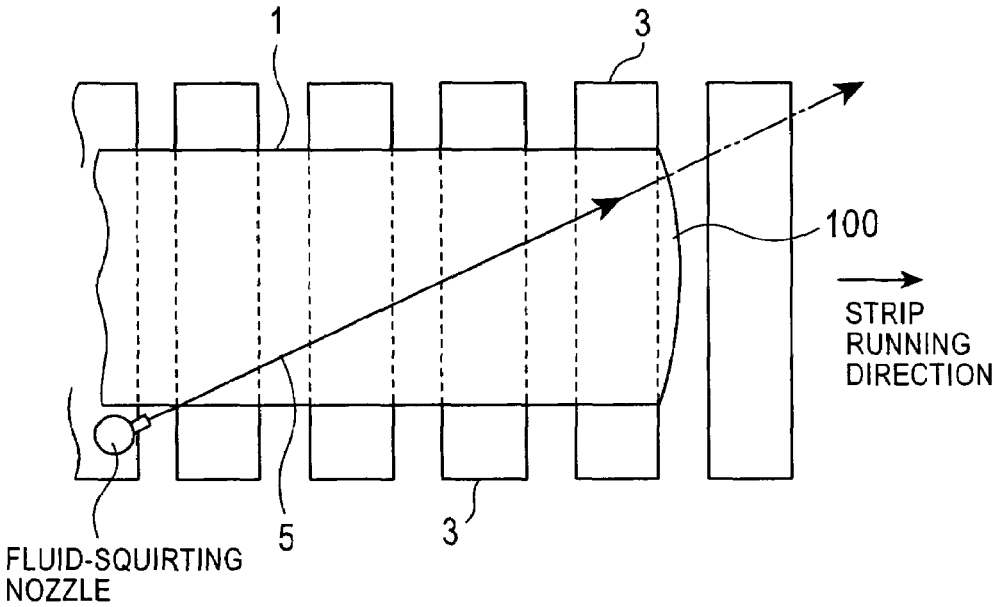
FIG. 2 is a plan view showing the squirting manner shown in FIG. 1.
Figure 3:
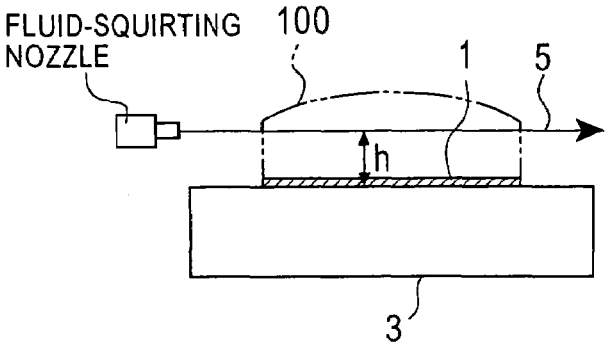
FIG. 3 is a front view showing the squirting manner shown in FIG. 1.

FIGS. 1, 2, and 3 show a squirting manner of a fluid jet 5 on a hot runout table in a production method according to an embodiment of the present invention. FIGS. 1, 2, and 3 are a side view, a plan view, and a front view, respectively, showing a hot runout table and a head end of a hot rolled strip conveyed by the hot runout table.

Figure 32:
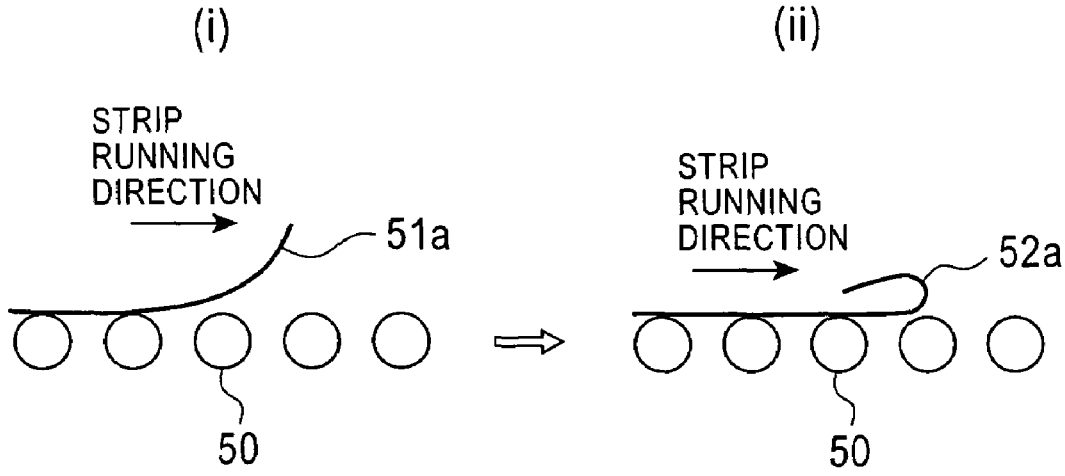
FIG. 32 is an explanatory view showing a state in which jumping and a head folding defect occur at the head end of a strip.
Figure 33:
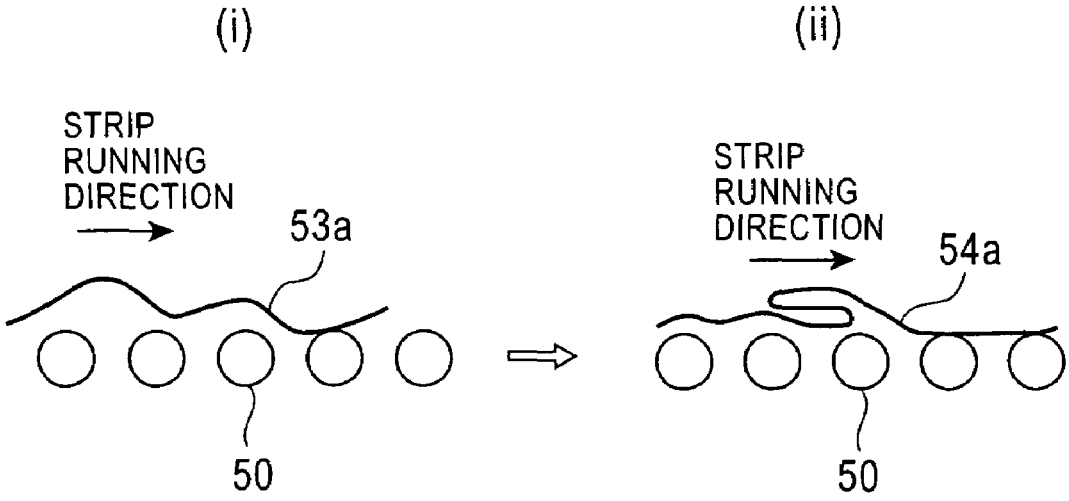
FIG. 33 is an explanatory view showing a state in which waving and a strip folding defect occur at the head end of a strip.
Figure 34:
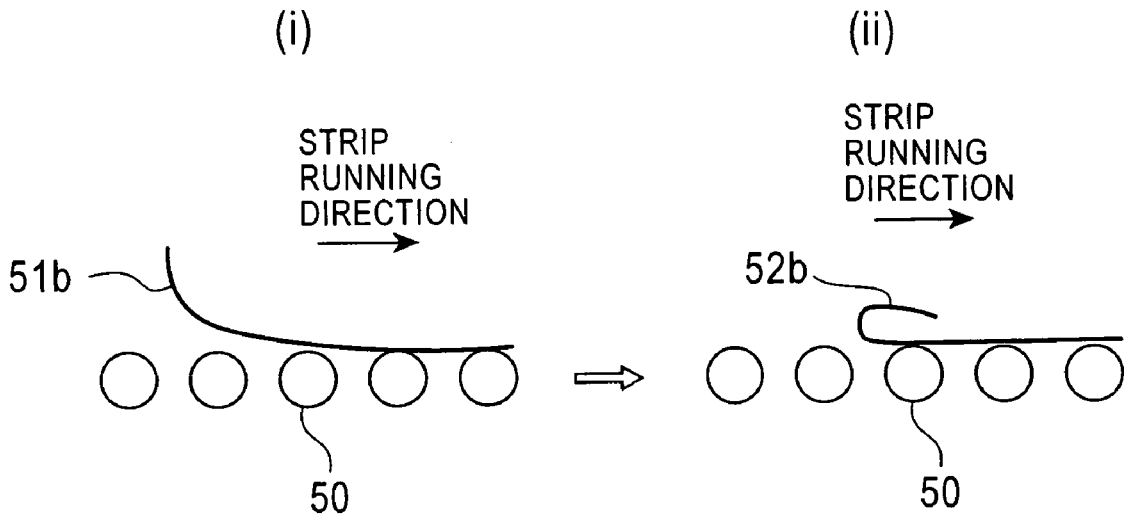
FIG. 34 is an explanatory view showing a state in which jumping and a tail folding defect occur at the tail end of a strip.
Figure 35:
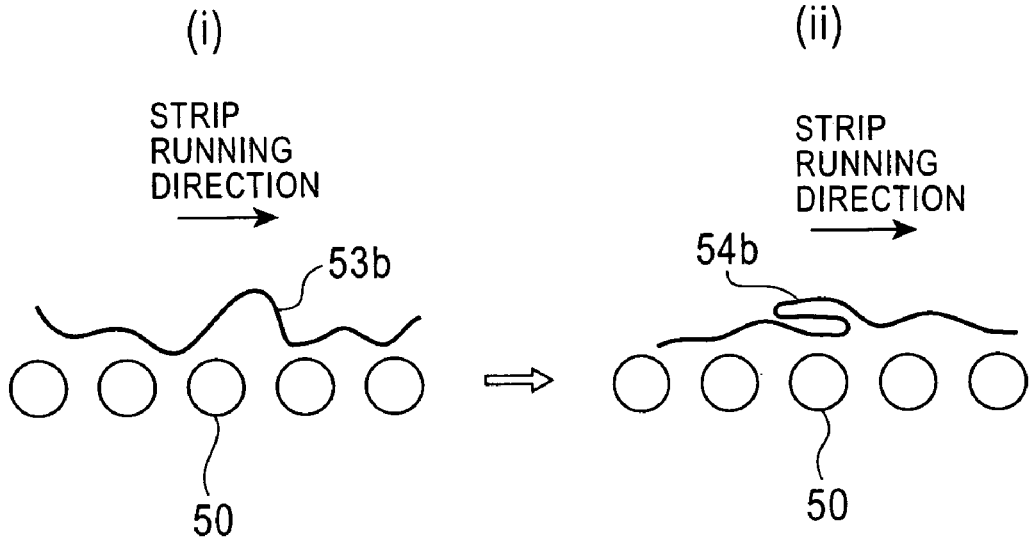
FIG. 35 is an explanatory view showing a state in which waving and a strip folding defect occur at the tail end of a strip.
Figure 36:
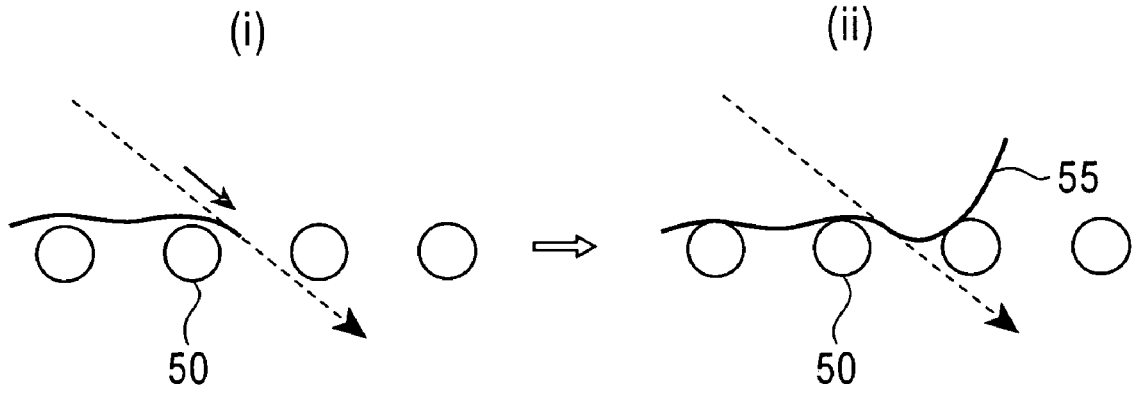
FIG. 36 is an explanatory view showing jumping caused at the head end of a normally running strip by collision of fluid when the conventional technique is carried out.
Figure 37A:
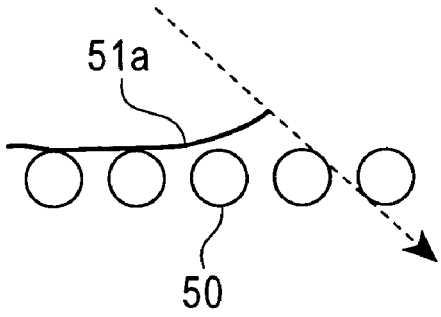
FIGS. 37A and 37B are explanatory views showing a phenomenon caused when fluid collides with a jumping head end of a strip when the conventional technique is carried out.
Figure 37B:
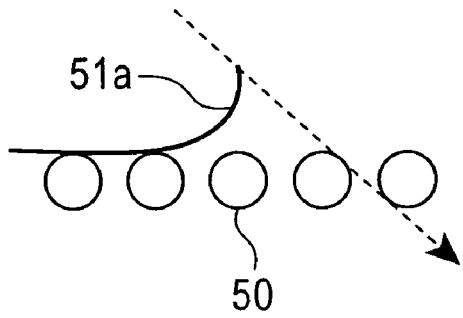

In the present invention, a beam-shaped fluid jet 5 is squirted above (an upper space) a hot rolled strip 1 conveyed by a hot runout table 3 so as to pass over the hot rolled strip 1 without touching a surface of the hot rolled strip 1 running on a pass line (a strip-conveying surface of the hot runout table). A strip portion 100 displaced upward from the pass line beyond a predetermined level (jumping at the head end of the strip in this embodiment) is caused to collide with the fluid jet 5 in order to correct the displacement thereof (to push back the portion toward the pass line). The strip portion 100 displaced upward beyond the predetermined level includes, for example, jumping at the head end of the strip as in this embodiment (see FIG. 32(*i*)), jumping at the tail end of the strip (see FIG. 34(*i*)), or waving at the head and tail ends of the strip (see FIG. 33(*i*) and FIG. 35(*i*)).

According to the present invention, when the strip portion 100 displaced above the pass line is pushed back toward the pass line by collision with the fluid jet 5, as described above, the displacement of the strip is corrected. The fluid jet 5 does not touch the surface of a strip portion that is not displaced upward beyond the predetermined level, but completely passes over the strip portion. Therefore, an impact force of the fluid jet 5 does not act on the strip that normally runs on the pass line (including a strip portion displaced upward below the predetermined level). Unlike the conventional technique, the strip is not displaced by collision with the fluid jet.

While the fluid jet 5 used in the present invention may be gas, liquid, or a mixture of gas and liquid, water is used in normal cases.

In the present invention, the squirting direction of the fluid jet 5 on the horizontal plane is basically arbitrarily determined except for the widthwise direction of the strip (a direction orthogonal to the strip running direction). The fluid jet 5 may be squirted in the strip running direction, or in a counter running direction (a direction opposite to the strip running direction). In the former case, the fluid jet 5 is squirted so that the angle $\alpha$ with respect to the strip running direction satisfies the condition $0° \leqq \alpha < 90°$. In the latter case, the fluid jet 5 is squirted so that the angle $\alpha$ with respect to the counter running direction satisfies the condition $0° \leqq \alpha < 90°$.

In order to more effectively and reliably eliminate the displacement of the strip, it is preferable that the fluid jet 5 be squirted in the strip running direction for a displacement at the head end of the strip (that is, the fluid jet 5 be squirted so that the angle $\alpha$ with respect to the strip running direction satisfies the condition $0° \leqq \alpha < 90°$). It is preferable that the fluid jet 5 be squirted in the counter running direction for a displacement at the tail end of the strip. That is, it is preferable that the fluid jet 5 be squirted so that the angle $\alpha$ with respect to the counter running direction satisfies the condition $0° \leqq \alpha < 90°$. Therefore, it is particularly preferable that the fluid jet 5 be squirted, on one hot runout table, at the head end of the hot rolled strip 1 so that the angle $\alpha$ with respect to the running direction satisfies the condition $0° \leqq \alpha < 90°$, and at the tail end so that the angle $\alpha$ with respect to the counter running direction satisfies the condition $0° \leqq \alpha < 90°$.

Figure 4A:
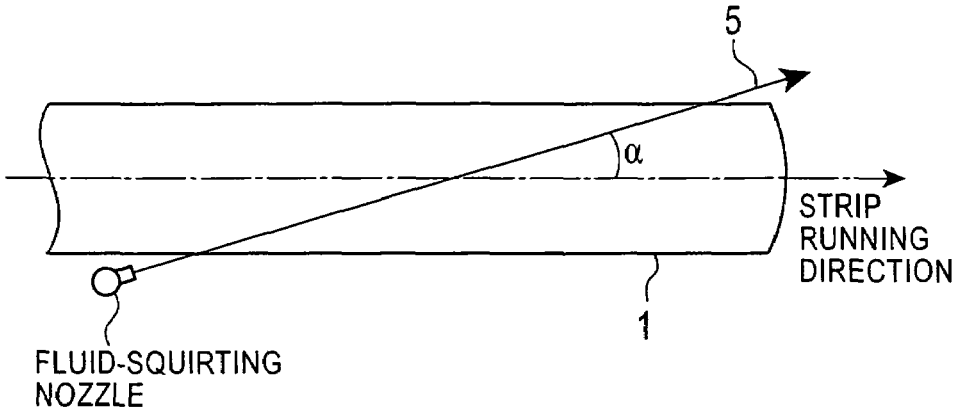
FIGS. 4A and 4B are explanatory views showing the squirting direction of a fluid jet on the horizontal plane when the fluid jet is squirted from the side of a hot runout table so as to completely pass over a hot rolled strip in the widthwise direction in the method of the present invention.
Figure 4B:
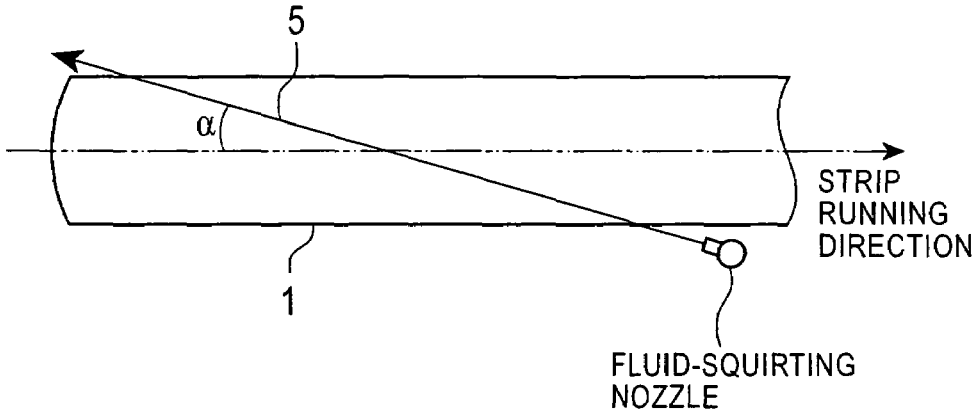

FIGS. 4A and 4B show the squirting directions on the horizontal plane when a fluid jet 5 is squirted from the side of the hot runout table 3 (including the adjacency of a side edge of the hot runout table) so as to completely pass over the hot rolled strip in the widthwise direction. FIG. 4A shows a case in which the fluid jet 5 is squirted in the strip running direction. In this case, the fluid jet 5 is squirted so that the angle $\alpha$ with respect to the strip running direction satisfies the condition $0° \leqq \alpha < 90°$. FIG. 4B shows a case in which the fluid jet 5 is squirted in the counter running direction. In this case, the fluid jet 5 is squirted so that the angle $\alpha$ with respect to the counter running direction satisfies the condition $0° \leqq \alpha < 90°$.

In order for an impact force of the fluid jet 5 (a thrust in the longitudinal direction of the pass line (strip running direction or counter running direction)) to effectively act on a strip portion displaced above the pass line, it is preferable to minimize the angle $\alpha$ of the squirting direction of the fluid jet 5 with respect to the longitudinal direction of the pass line. In contrast, when the fluid jet 5 crosses over the hot rolled strip in the widthwise direction, it is necessary to increase the flow velocity of the fluid jet 5 because the length of the fluid jet 5 passing over the hot rolled strip 1 increases as the angle $\alpha$ decreases. From the above viewpoints, when the fluid jet 5 is squirted so as to completely pass over the hot rolled strip in the widthwise direction, as shown in FIGS. 4A and 4B, it is rational that the angle $\alpha$ of the squirting direction of the fluid jet 5 with respect to the longitudinal direction of the pass line (strip running direction or counter running direction) is within the range of approximately 5° to 45°, more preferably, approximately 5° to 15°.

Figure 5:
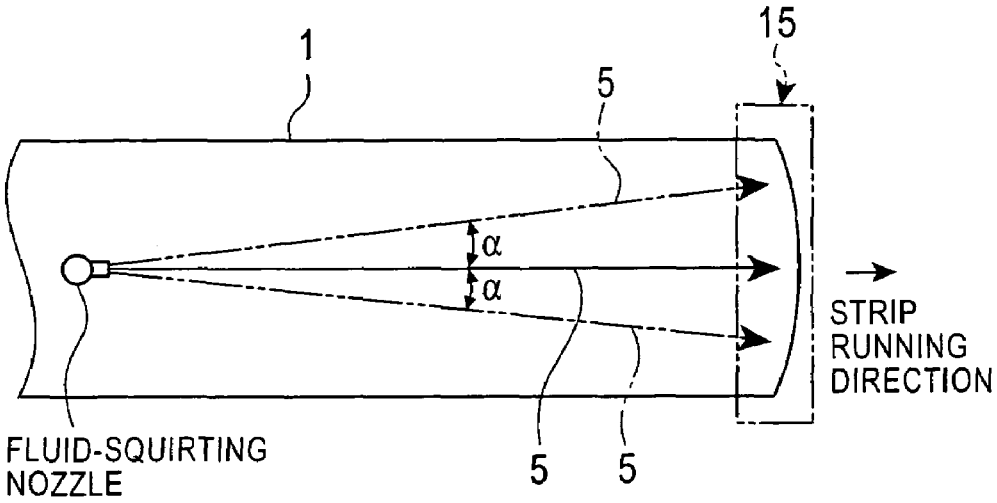
FIG. 5 is a plan view showing an embodiment in which a fluid jet is squirted from above a pass line on the hot runout table in the method of the present invention.
Figure 6:
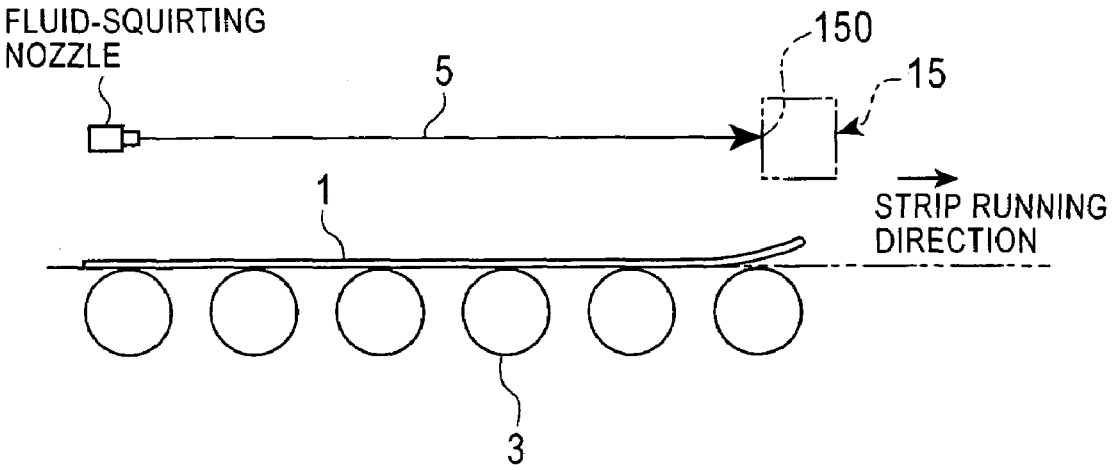
FIG. 6 is a side view showing the embodiment shown in FIG. 5.

While the fluid jet 5 is squirted from the side of the hot runout table 3 in FIGS. 1 to 4, it may be squirted from above the pass line on the hot runout table 3. FIGS. 5 and 6 are a plan view and a side view, respectively, showing such an embodiment. In this case, a fluid jet 5 may be guided toward the sides of the hot runout table 3 by being squirted at an angle $\alpha$ to the longitudinal direction of the pass line (strip running direction or counter running direction). Alternatively, a collecting means 15 may be provided above the hot rolled strip on the downstream side in the squirting direction of the fluid jet 5 to collect the fluid jet 5, and the fluid jet 5 may be collected by the collecting means 15 so as to be prevented from landing on the surface of the hot rolled strip. The collecting means 15 is, for example, a duct having an opening 150 through which the fluid jet 5 can enter, as shown in the figures.

Figure 7:
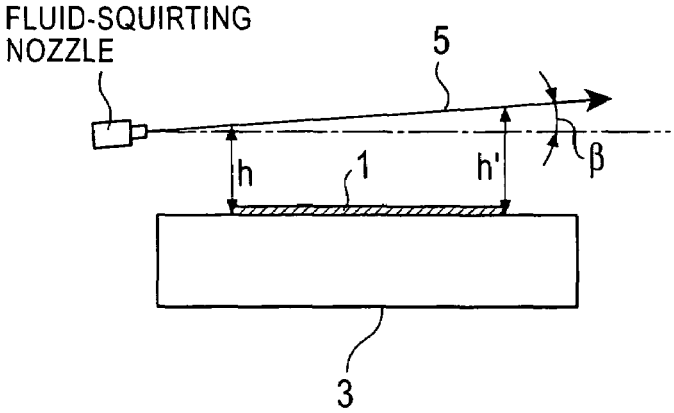
FIG. 7 is a front view showing an embodiment in which the squirting direction of a fluid jet is inclined with respect to the horizontal plane in the method of the present invention.

The squirting direction of the fluid jet 5 may be inclined upward or downward with respect to the horizontal plane. FIG. 7 is a front view showing an embodiment in which the squirting direction of the fluid jet 5 is inclined with respect to the horizontal plane. This inclination of the squirting direction of the fluid jet 5 may be provided in both the embodiments shown in FIGS. 1 to 4 and FIGS. 5 and 6. However, in order for an impact force of the fluid jet to effectively act on a strip portion displaced above the pass line, it is preferable that the fluid jet 5 be as horizontal as possible. For this reason, it is preferable that the inclination angle $\beta$ of the squirting direction of the fluid jet 5 with respect to the horizontal plane be $\pm 10°$ or less.

The fluid jet 5 is squirted by a fluid-squirting nozzle. The position and squirting direction of the fluid-squirting nozzle are determined in accordance with the above-described squirting position and squirting direction of the fluid jet 5.

Figure 8:
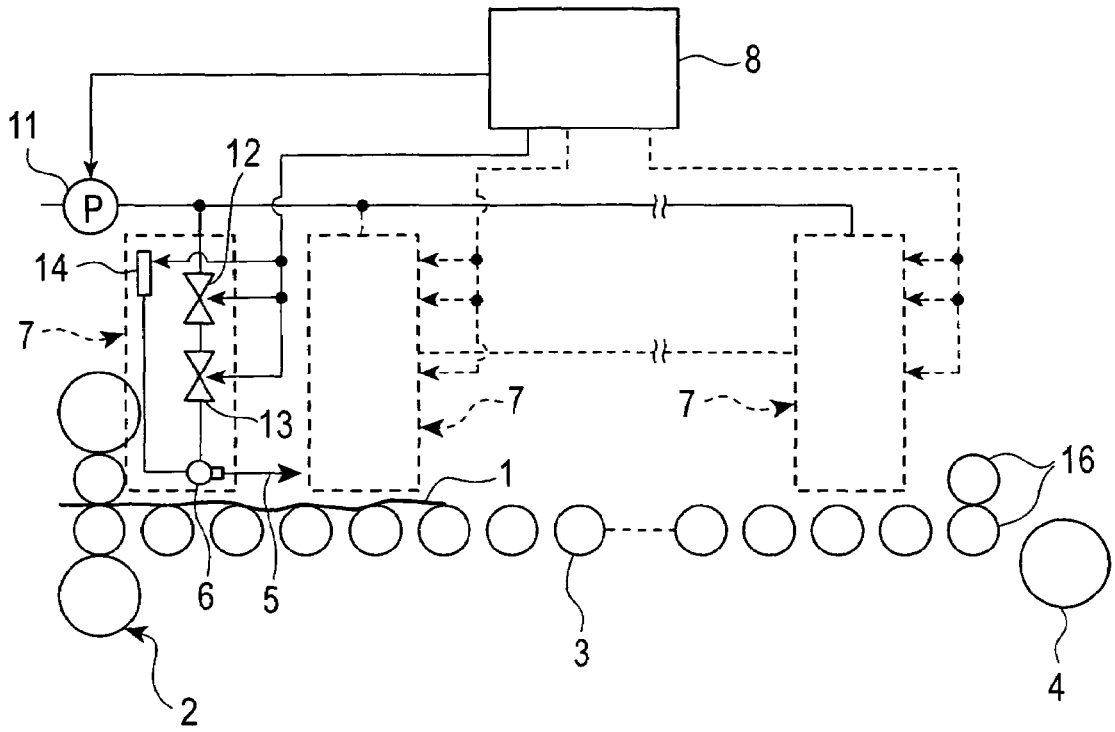
FIG. 8 is a side view showing an embodiment of a system used to carry out the method of the present invention.
Figure 9:
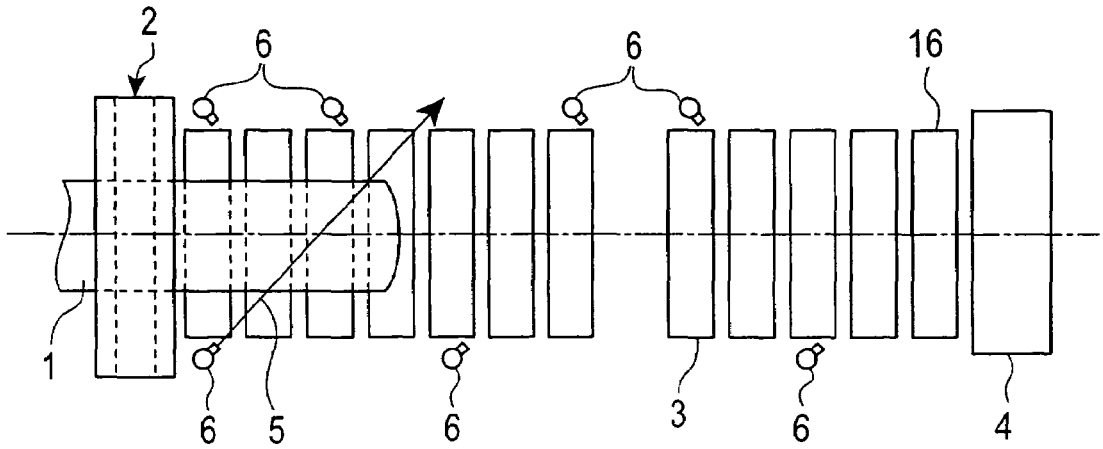
FIG. 9 is a plan view showing the embodiment shown in FIG. 8.

FIGS. 8 and 9 show an embodiment of a system for carrying out the hot-rolled-strip production method of the present invention. FIG. 8 is a side view of a final stand of a hot finishing rolling mill and exit-side devices, and FIG. 9 is a plan view thereof.

In FIGS. 8 and 9, reference numeral 2 denotes a final stand of a hot finishing rolling mill that constitutes a hot rolling train, 3 denotes a hot runout table provided on the exit side of the hot rolling train to convey a hot rolled strip, and 4 denotes a coiler 4 for coiling a hot rolled strip 1 conveyed by the hot runout table 3.

The hot runout table 3 includes multiple table rolls. A cooling device (not shown) is provided above or below the hot runout table 3 to supply cooling fluid, such as cooling water, to a conveyed hot rolled strip. Pinch rolls 16 are provided on the entrance side of the coiler 4 to pinch and guide the hot rolled strip 1 conveyed on the hot runout table 3 to the coiler 4.

With this basic system configuration, a plurality of fluid-squirting nozzles 6 are appropriately spaced in the longitudinal direction of the hot runout table 3 on both sides of the hot runout table 3, and squirt fluid jets 5 above a hot rolled strip 1 running on the hot runout table 3. Various arrangement manners of the fluid-squirting nozzles 6 will be described in detail later.

Each of the fluid-squirting nozzles 6 is connected to a fluid supply system 7, and, for example, the flow rate and squirting timing of a fluid jet 5 to be squirted from the fluid-squirting nozzle 6 are controlled by a controller 8 for controlling the fluid supply system 7. The fluid supply system 7 includes a fluid feeding pump 11, a flow-rate adjustment valve 12 for adjusting the flow rate of the fluid to be discharged from the pump 11, an on-off valve 13 for supplying the fluid to the fluid-squirting nozzle 6 when opened, and an angle adjustment mechanism 14, such as an actuator, for adjusting the angle of the fluid-squirting nozzle 6.

In this production system for hot rolled strips, a hot rolled strip 1 supplied from the final stand 2 of the hot finishing rolling mill is guided onto the hot runout table 3, is cooled to a predetermined temperature while being conveyed by the hot runout table 3, and is then coiled with the coiler 4. While the hot rolled strip 1 is running on the hot runout table 3, fluid jets 5 are squirted from the fluid-squirting nozzles 6 above the hot rolled strip 1 in a manner shown in FIGS. 1 to 3.

A description will now be given of how the displacement of the hot rolled strip is eliminated by the fluid jet 5 in the present invention, with reference to FIGS. 10 to 13.

Figure 10:
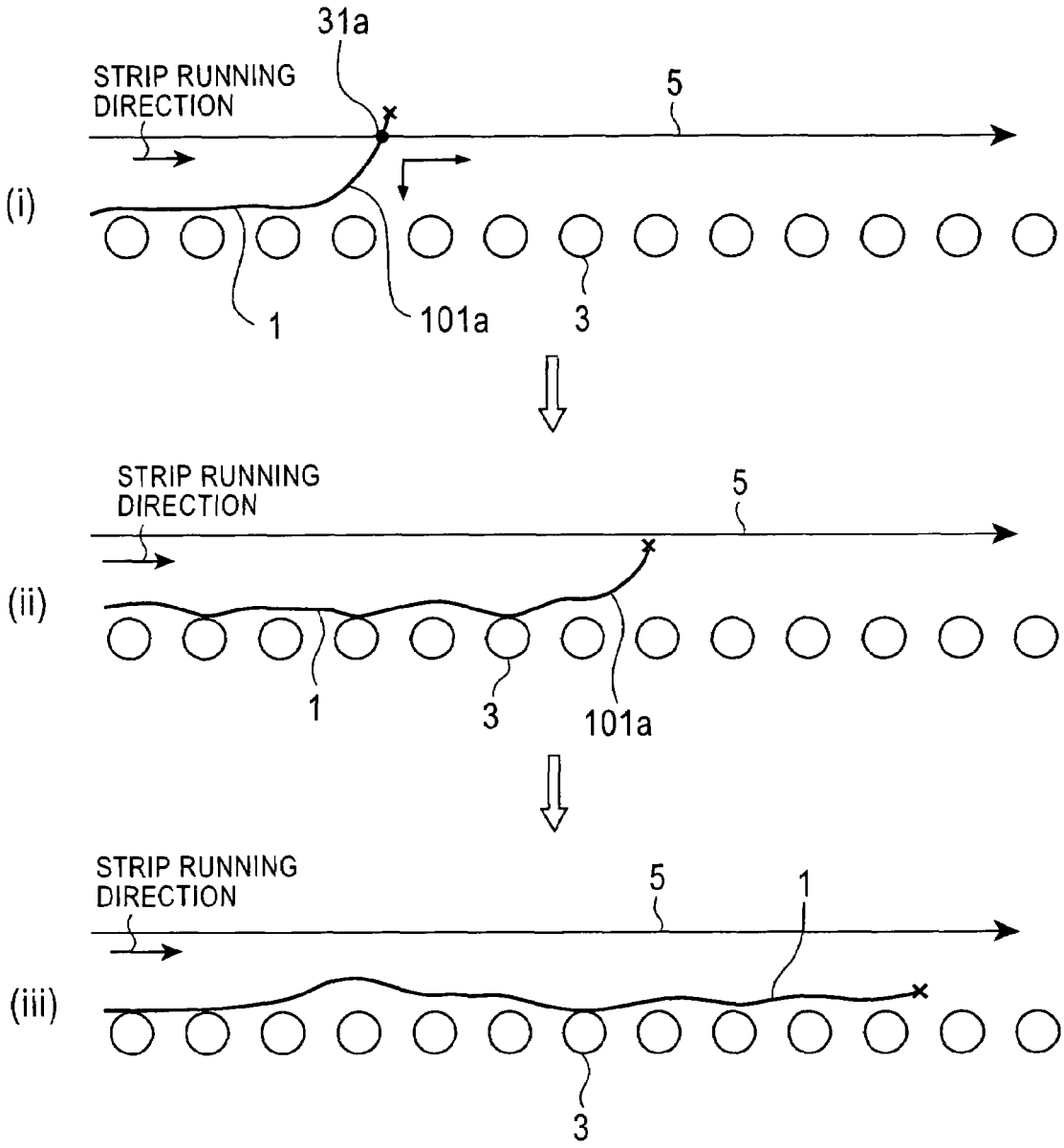
FIG. 10 is an explanatory view showing a process in which jumping at the head end of a strip is eliminated by a fluid jet in the method of the present invention.

FIG. 10 shows a process in which jumping at the head end of a hot rolled strip is eliminated by a fluid jet 5. Herein, the fluid jet 5 is squirted from the fluid-squirting nozzle 6 in the strip running direction (the angle $\alpha$ defined between the fluid jet 5 and the strip running direction: $0° \leqq \alpha < 90°$) under the conditions of the present invention before jumping 101*a* becomes large. When the jumping 101*a* increases in size in this state, it collides with the fluid jet 5 (see FIG. 10(*i*)), and a substantially horizontal impact force of the fluid jet 5 acts on a collision point 31*a* near the top of the jumping 101*a*. The impact force acts as a pass-line longitudinal component (a component for pushing the jumping 101*a* in the strip running direction) and a vertical component (a component for pushing the jumping 101*a* toward the pass line). As a result, as shown in FIG. 10(*ii*), the jumping 101*a* is pushed out in the strip running direction, is pushed back toward the pass line (in the vertical direction), and is eliminated, as shown in FIG. 10(*iii*), so that a stable running state is brought about. Since the fluid jet 5 flows so as to completely pass over the hot rolled strip 5 at a predetermined height, it does not touch a portion of the strip running below the height, and does not push a portion of the strip that is normally running between the table rolls of the hot runout table 3. For this reason, it is possible to reliably and effectively suppress and eliminate jumping.

Figure 11:
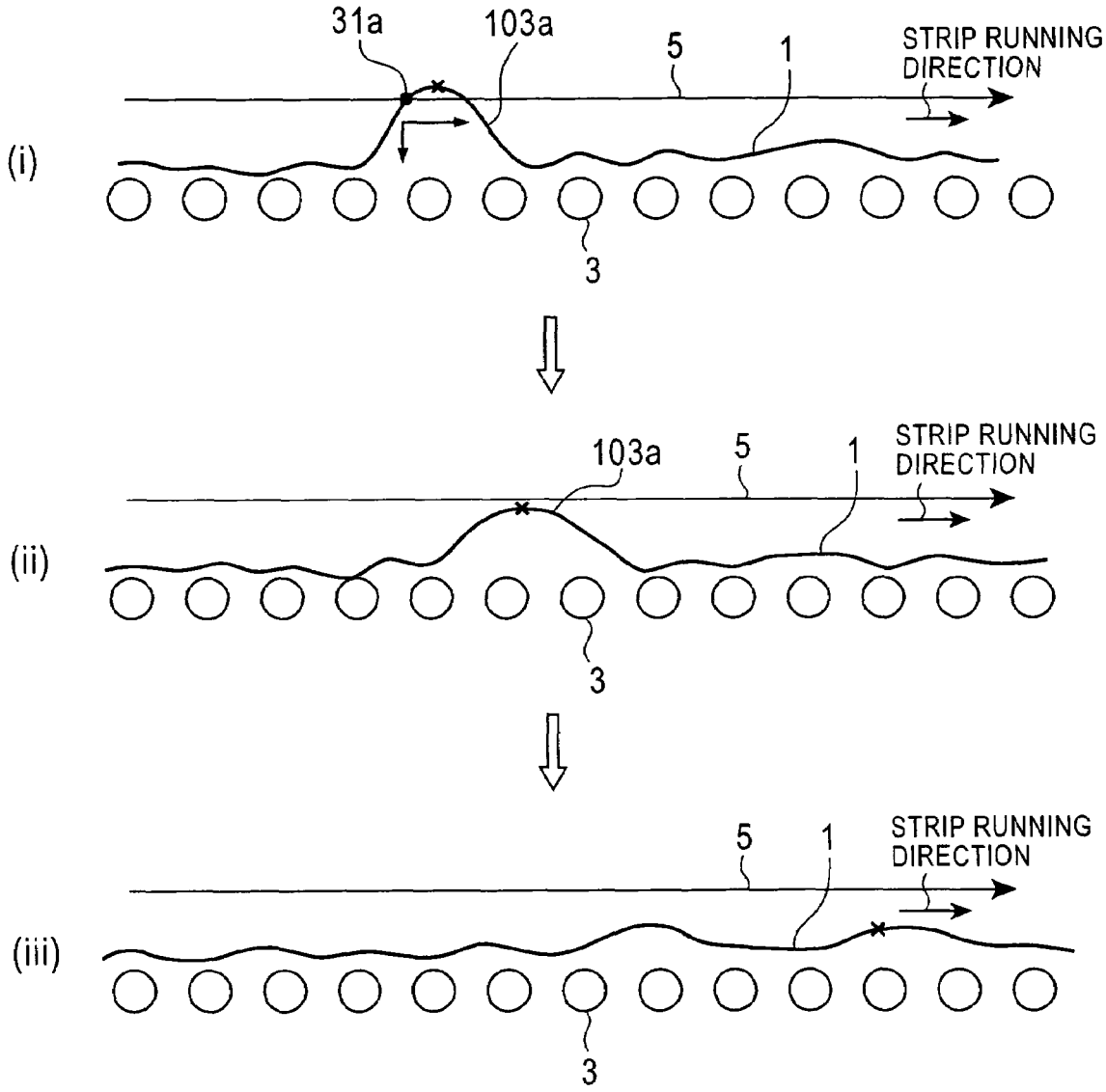
FIG. 11 is an explanatory view showing a process in which waving at the head end of a strip is eliminated by a fluid jet in the method of the present invention.

FIG. 11 shows a process in which waving at the head end of a hot rolled strip is eliminated by a fluid jet 5. Herein, the fluid jet 5 is squirted from the fluid-squirting nozzle 6 in the strip running direction (the angle $\alpha$ defined between the fluid jet 5 and the strip running direction: $0° \leqq \alpha < 90°$) under the conditions of the present invention before a waving 103*a* becomes large. When the waving 103*a* increases in size in this state, it collides with the fluid jet 5 (see FIG. 11(*i*)), and a substantially horizontal impact force of the fluid jet 5 acts on a collision point 31*a* near the top of the waving 103*a*. The impact force acts as a pass-line longitudinal component (a component for pushing the waving 103*a* in the strip running direction) and a vertical component (a component for pushing the waving 103*a* toward the pass line). As a result, as shown in FIG. 11(*ii*), the waving 103*a* is pushed out in the strip running direction, is pushed back toward the pass line (in the vertical direction), and is eliminated, as shown in FIG. 11(*iii*), so that a stable running state is brought about. Since the fluid jet 5 flows so as to completely pass over the hot rolled strip 1 at a predetermined height, it does not touch a portion of the strip running below the height, and does not push a portion of the strip that is normally running between the table rolls of the hot runout table 3. For this reason, it is possible to reliably and effectively suppress and eliminate waving.

Figure 12:
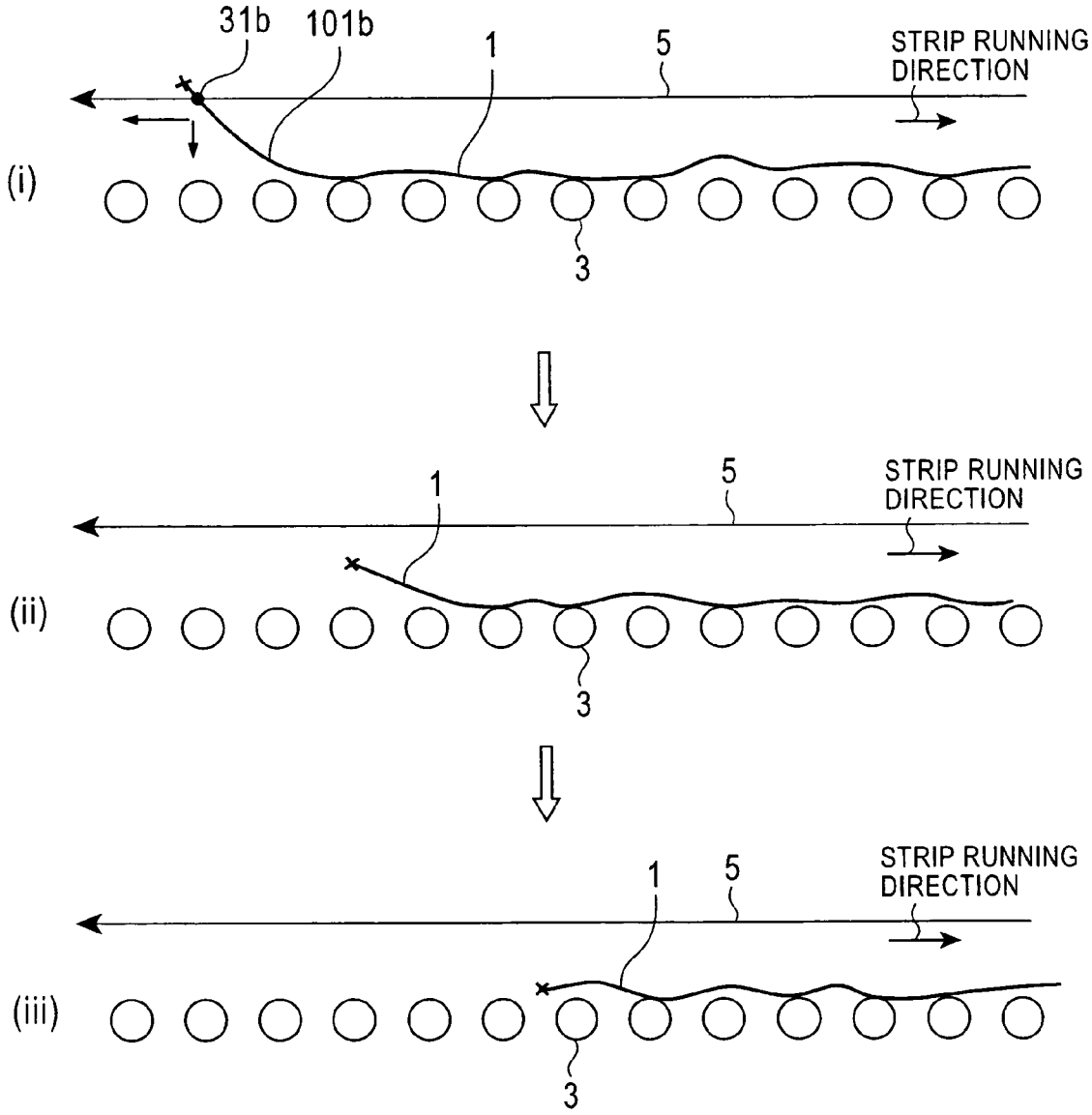
FIG. 12 is an explanatory view showing a process in which jumping at the tail end of a strip is eliminated by a fluid jet in the method of the present invention.

FIG. 12 shows a process in which jumping at the tail end of a hot rolled strip is eliminated by a fluid jet 5. Herein, the fluid jet 5 is squirted from the fluid-squirting nozzle 6 in the counter running direction (the angle $\alpha$ defined between the fluid jet 5 and the counter running direction: $0° \leqq \alpha < 90°$) under the conditions of the present invention before a jumping 101*b* becomes large. When the jumping 101*b* increases in size in this state, it collides with the fluid jet 5 (see FIG. 12(*i*)), and a substantially horizontal impact force of the fluid jet 5 acts on a collision point 31*b* near the top of the jumping 101*b*. The impact force acts as a pass-line longitudinal component (a component for pushing the jumping 101*b* in the counter running direction) and a vertical component (a component for pushing the jumping 101*b* toward the pass line). As a result, as shown in FIG. 12(*ii*), the jumping 101*b* is pushed out in the counter running direction, is pushed back toward the pass line (in the vertical direction), and is eliminated, as shown in FIG. 12(*iii*), so that a stable running state is brought about. Since the fluid jet 5 flows so as to completely pass over the hot rolled strip 1 at a predetermined height, it does not touch a portion of the strip running below the height, and does not push a portion of the strip that is normally running between the table rolls of the hot runout table 3. For this reason, it is possible to reliably and effectively suppress and eliminate jumping.

Figure 13:
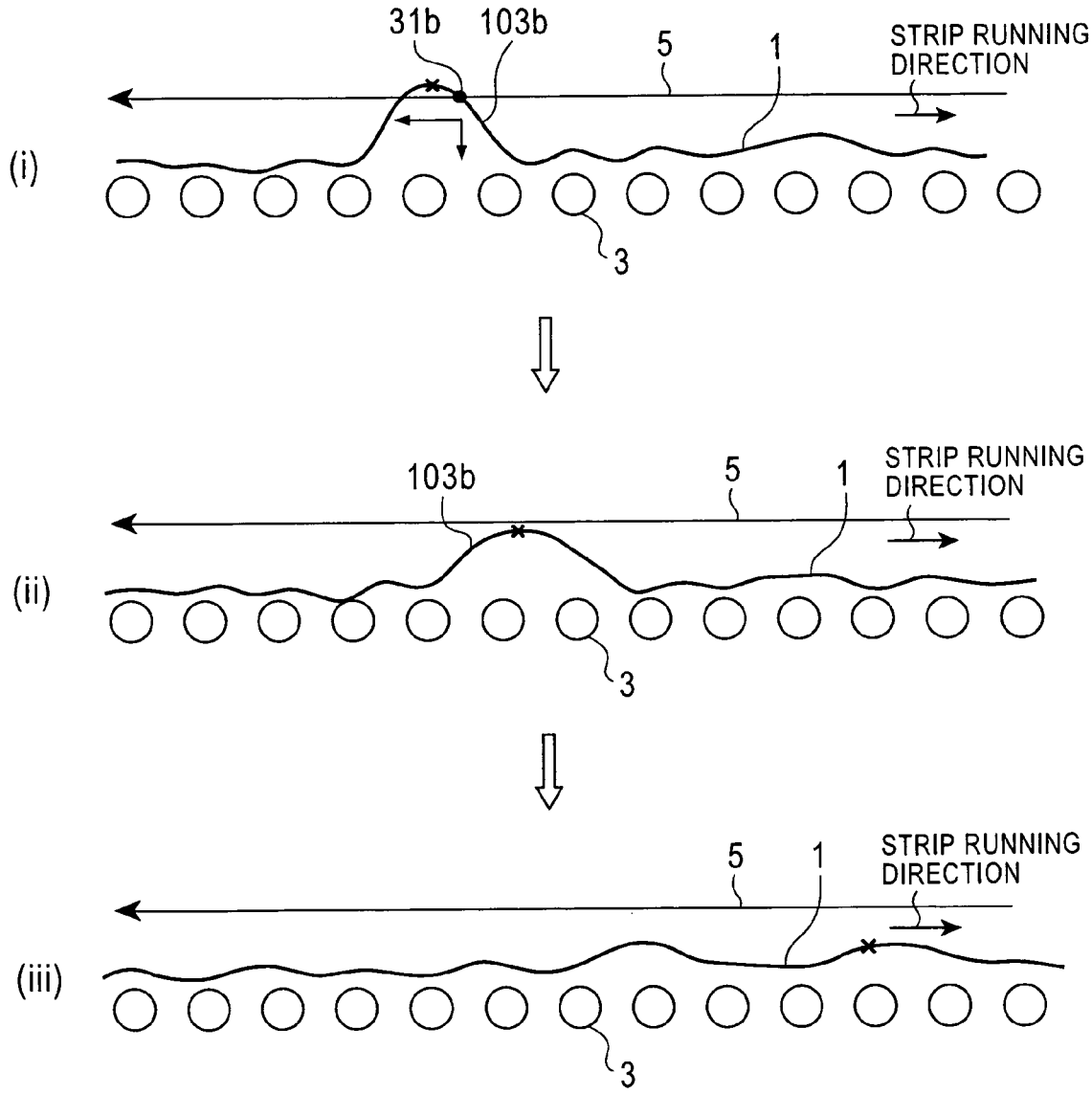
FIG. 13 is an explanatory view showing a process in which waving at the tail end of a strip is eliminated by a fluid jet in the method of the present invention.

FIG. 13 shows a process in which waving at the tail end of a hot rolled strip is removed by a fluid jet 5. Herein, the fluid jet 5 is squirted from the fluid-squirting nozzle 6 in the counter running direction (the angle α defined between the fluid jet 5 and the counter running direction: $0° \leqq \alpha < 90°$) under the conditions of the present invention before a waving 103*b* becomes large. When the waving 103*b* increases in size in this state, it collides with the fluid jet 5 (see FIG. 13(*i*)), and a substantially horizontal impact force of the fluid jet 5 acts on a collision point 31*b* near the top of the waving 103*b*. The impact force acts as a pass-line longitudinal component (a component for pushing the waving 103*b* in the counter running direction) and a vertical component (a component for pushing the waving 103*b* toward the pass line). As a result, as shown in FIG. 13(*ii*), the waving 103*b* is pushed out in the counter running direction, is pushed back toward the pass line (in the vertical direction), and is eliminated, as shown in FIG. 13(*iii*), so that a stable running state is brought about. Since the fluid jet 5 flows so as to completely pass over the hot rolled strip 1 at a predetermined height, it does not touch a portion of the strip running below the height, and does not push a portion of the strip that is normally running between the table rolls of the hot runout table 3. For this reason, it is possible to reliably and effectively suppress and eliminate waving.

A particularly preferable embodiment of the present invention will be described below.

In the present invention, in order to particularly effectively correct the displacement of the strip, it is preferable that the height of a center line of a fluid jet 5 passing above the hot rolled strip from the pass line (the height h shown in FIGS. 1, 3, and 7) be more than or equal to 50 mm and less than or equal to 450 mm, more preferably, more than or equal to 50 mm and less than 200 mm.

From a similar viewpoint, it is preferable that the line-direction thrust $F_L$ of the fluid jet 5 passing above the hot rolled strip be defined by the following equation (1), and be set to be within the range of 10 kgf to 50 kgf:

$$F_L = [\rho A(v \cos(\pi \times \alpha/180) - u)^2]/9.8 \quad (1)$$

wherein

ρ: the density of fluid that forms the fluid jet ($kg/m^3$)

A: the cross-sectional area of the aperture of the fluid squirting nozzle ($m^2$)

v: the velocity of the fluid jet (m/sec)

u: the running velocity of the hot rolled strip (m/sec)

α: the angle of the squirting direction of the fluid jet with respect to the strip running direction (°)

The line-direction thrust $F_L$ is a thrust (impact force) in the longitudinal direction of the pass line that is applied to a strip portion displaced above the pass line by a fluid jet 5 squirted in the strip running direction ($0° \leqq \alpha < 90°$) when the fluid jet 5 collides with the strip portion. The strip portion displaced above the pass line is pushed back in the vertical direction (toward the pass line) by a vertical force resulting from the thrust.

The above-described preferable conditions of the present invention were known from a simulation test conducted by the present inventors. The test results will be described below.

The present inventors conducted a simulation test for the running conditions of a hot rolled strip on the hot runout table by using multibody-Dynamics. In this simulation, running conditions of the strip (displacement conditions of the strip) were reproduced while changing the height of the center line of a fluid jet passing above the hot rolled strip from the pass line (hereinafter, referred to as "fluid-jet height h") and the above-described line-direction thrust $F_L$.

Simulation conditions are as follows:

Specifications of the hot runout table

Table roll pitch: 420 mm

Table roll diameter: 375 nm

Figure 21A:
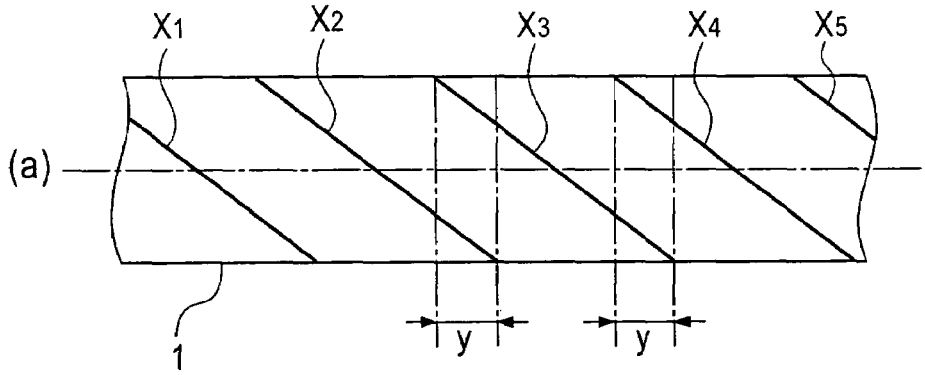
FIGS. 21A and 21B are explanatory views showing imaginary jet pass lines x obtained by projecting the paths of fluid jets onto the surface of the hot rolled strip in the method of the present invention.

Squirting manner of the fluid jet: Fluid jets are squirted so that regions in which the fluid jets are passing above the strip are consecutively provided in the longitudinal direction of the strip, as shown in FIG. 21A.

Strip running velocity (rolling velocity of the final stand of the hot finishing rolling mill): 690 m/min Width of the hot rolled strip: 650 mm Thickness of the hot rolled strip: 1.2 mm Length of the hot rolled strip: 1000 mm (the analysis of running for 1 m from the head end is assumed)

Simulation section: 35 m on the downstream side of the final stand

First, simulations were performed while changing the fluid-jet height h in steps of 50 mm from 50 mm to 500 mm and changing the line-direction thrust $F_L$ in steps of 10 kgf from 10 kgf to 100 kgf. As a result, it was revealed that the action of the fluid jet is hardly effective for jumping at the head end of the strip when the fluid-jet height h exceeds a certain level, and that a phenomenon in which a jumping portion of the strip sticks to the lower side of the fluid jet (hereinafter referred to as "sticking") tends to occur within a certain range of the fluid-jet height h even when the height h allows the fluid jet to achieve an effect of suppressing jumping. This sticking is prone to cause trouble such as a head folding defect of the strip. Even if a head folding defect is not caused, when sticking of the head of the strip remains at the entrance side of the coiler, trouble occurs, for example, the head end of the strip is not properly pinched between the pinch rollers on the entrance side of the coiler.

Figure 14:
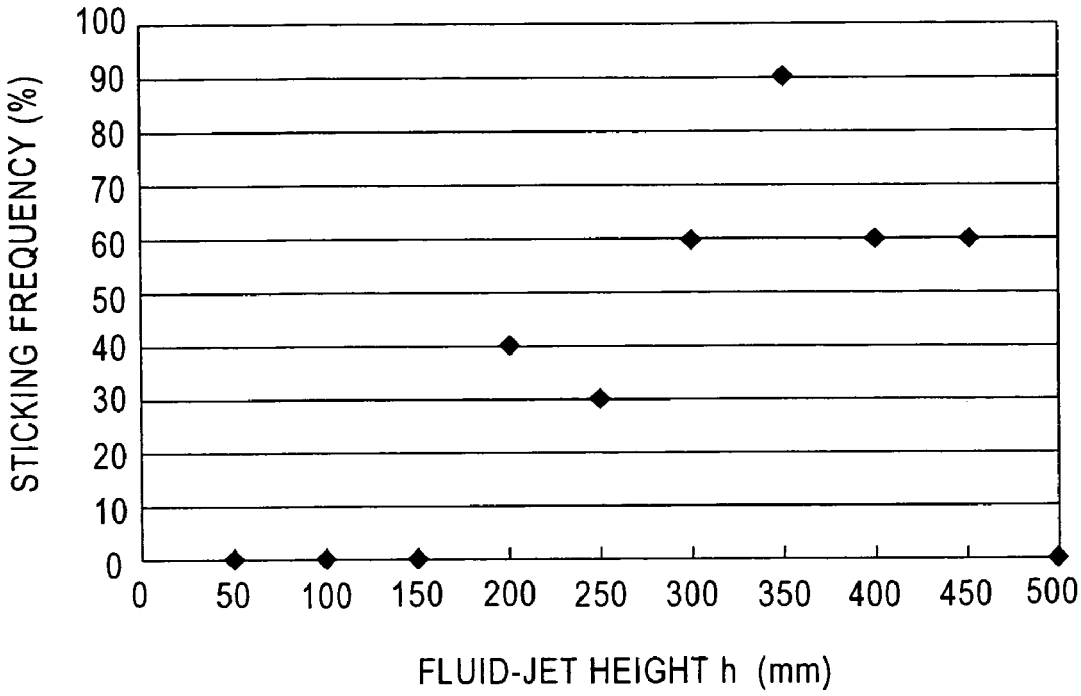
FIG. 14 is a graph showing the results of simulations, which were conducted to examine a preferable range of the fluid-jet height h, in conjunction with the frequency of sticking in the method of the present invention.

FIG. 14 shows the simulation results in conjunction with the frequency of sticking. The number of simulation sections in each of which "sticking" occurs at least once is counted. The sticking frequency refers to the ratio (%) of the number of simulations in which "sticking" occurs to the total number of simulations at each fluid-jet height h.

Referring to FIG. 14, sticking does not occur when the fluid-jet height h is 500 mm. Since jumping does exceed 500 mm, it does not collide with the fluid jet even when the fluid-jet height h is set at 500 mm or more. Therefore, the fluid jet 5 is not effective in suppressing jumping.

When the fluid-jet height h is 450 mm or less, a jumping portion collides with the fluid jet. However, sticking occurs when the fluid-jet height h is within the range of 200 mm to 450 mm, and the frequency of sticking is high particularly within the range of 300 mm to 450 mm. In contrast, when the fluid-jet height h is less than 200 mm (50 mm or more), sticking does not occur. When the fluid-jet height h is 200 mm or more, a jumping portion that becomes large to some extent collides with the fluid jet 5, and the lift and thrust produced at the jumping are balanced. Therefore, sticking easily occurs. In contrast, when the fluid-jet height is less than 200 mm, a jumping portion collides with the fluid jet 5 before it increases in size, that is, when the lift produced at the jumping portion is small.

The above results reveal that it is preferable that the fluid-jet height h be 450 mm or less in order for the displaced strip portion to reliably collide with the fluid jet, and that the fluid-jet height h is 250 mm or less, preferably, less than 200 mm in order to prevent the strip from sticking to the lower side of the fluid jet. When the fluid-jet height h is too small, the fluid jet may collide with a strip portion that is stably running on the hot runout table (including a portion of the strip displaced upward below a predetermined level), or may land on the hot rolled strip. From this viewpoint, it is preferable to set the fluid-jet height h at 50 mm or more.

For the above reasons, it is preferable that the fluid-jet height h be more than or equal to 50 mm and less than or equal to 450 mm, more preferably, more than or equal to 50 mm and less than 200 mm in order to properly suppress the displacement of the strip above the pass line and to achieve stable running of the strip. When the fluid jet 5 is squirted from the fluid-squirting nozzle 6 in the substantially horizontal direction, it is preferable that the height of the center of the aperture of the fluid-squirting nozzle 6 from the pass line be more than or equal to 50 mm and less than or equal to 450 mm, more preferably, more than or equal to 50 mm and less than 200 mm.

Figure 15:
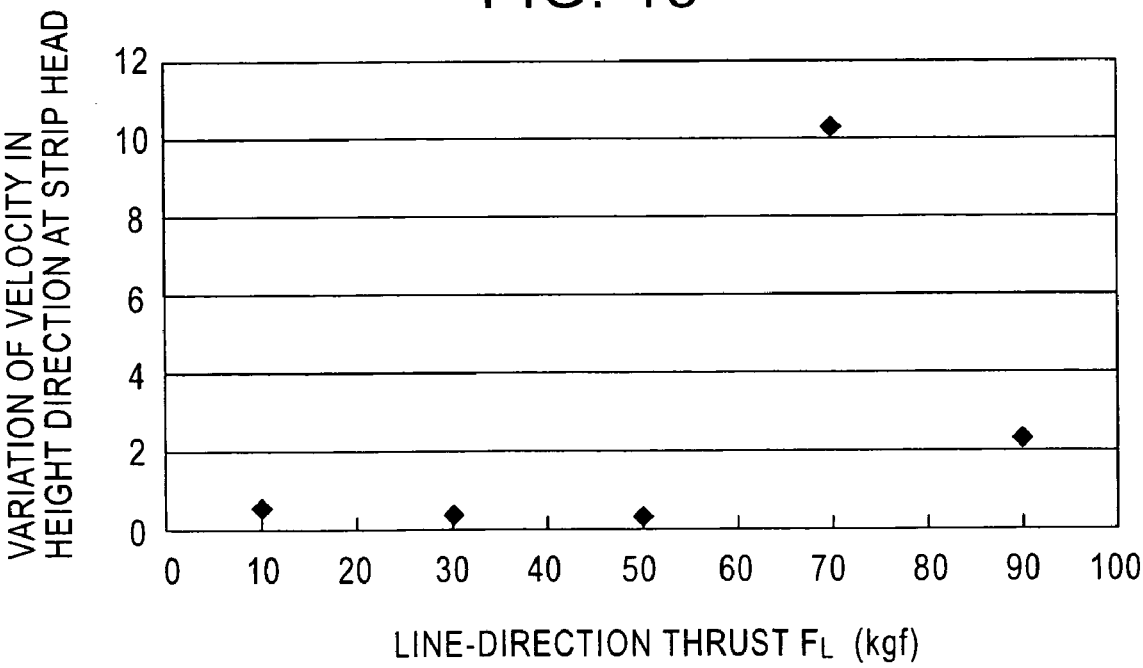
FIG. 15 is a graph showing the results of simulations, which were conducted to examine a preferable range of the line-direction thrust $F_L$ of the fluid jet, in conjunction with the variation of velocity in the height direction at the strip head end in the method of the present invention.
Figure 16:
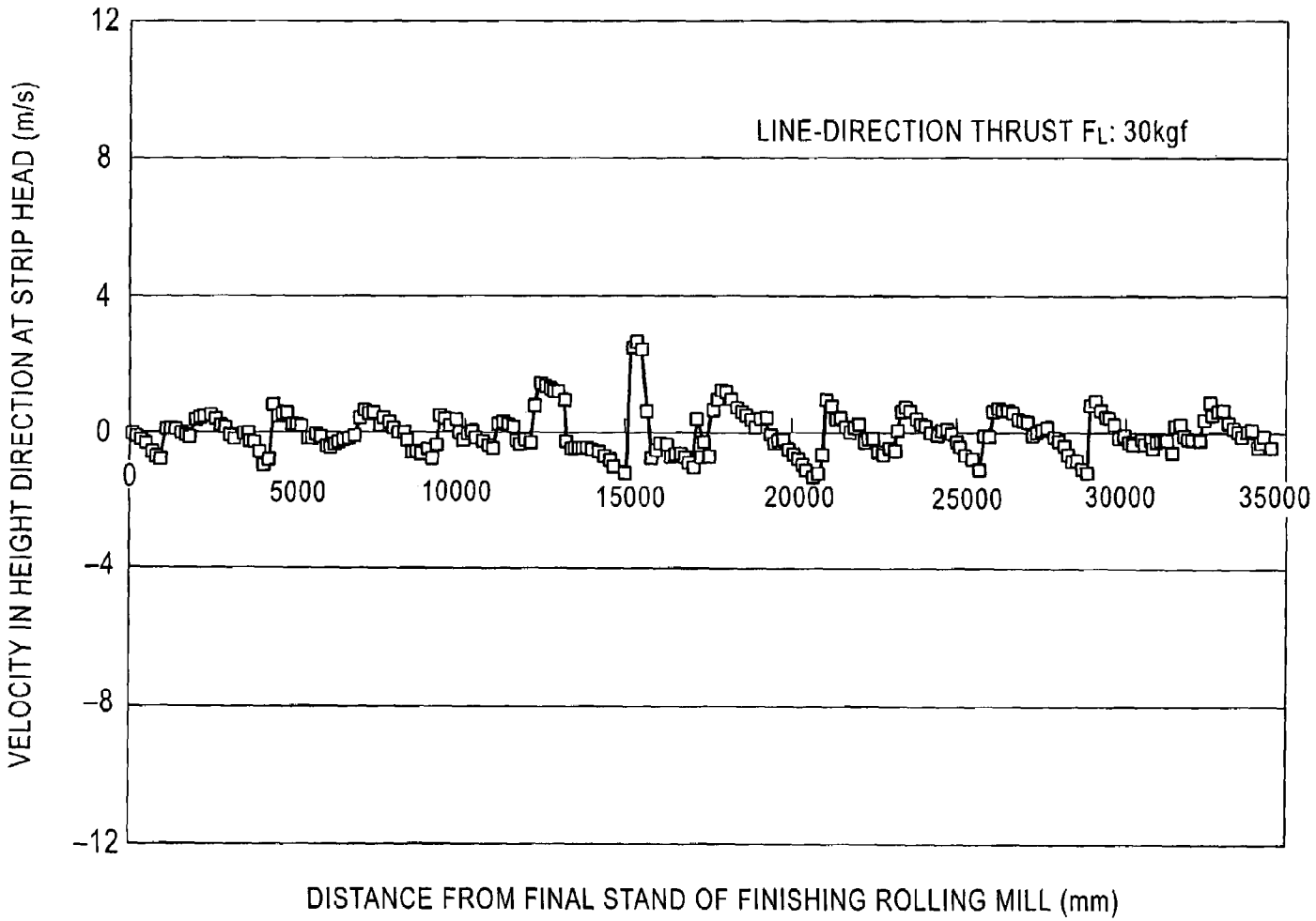
FIG. 16 is an explanatory view showing the changes in velocity in the height direction at the strip head end in an example of a simulation used in FIG. 15.
Figure 17:
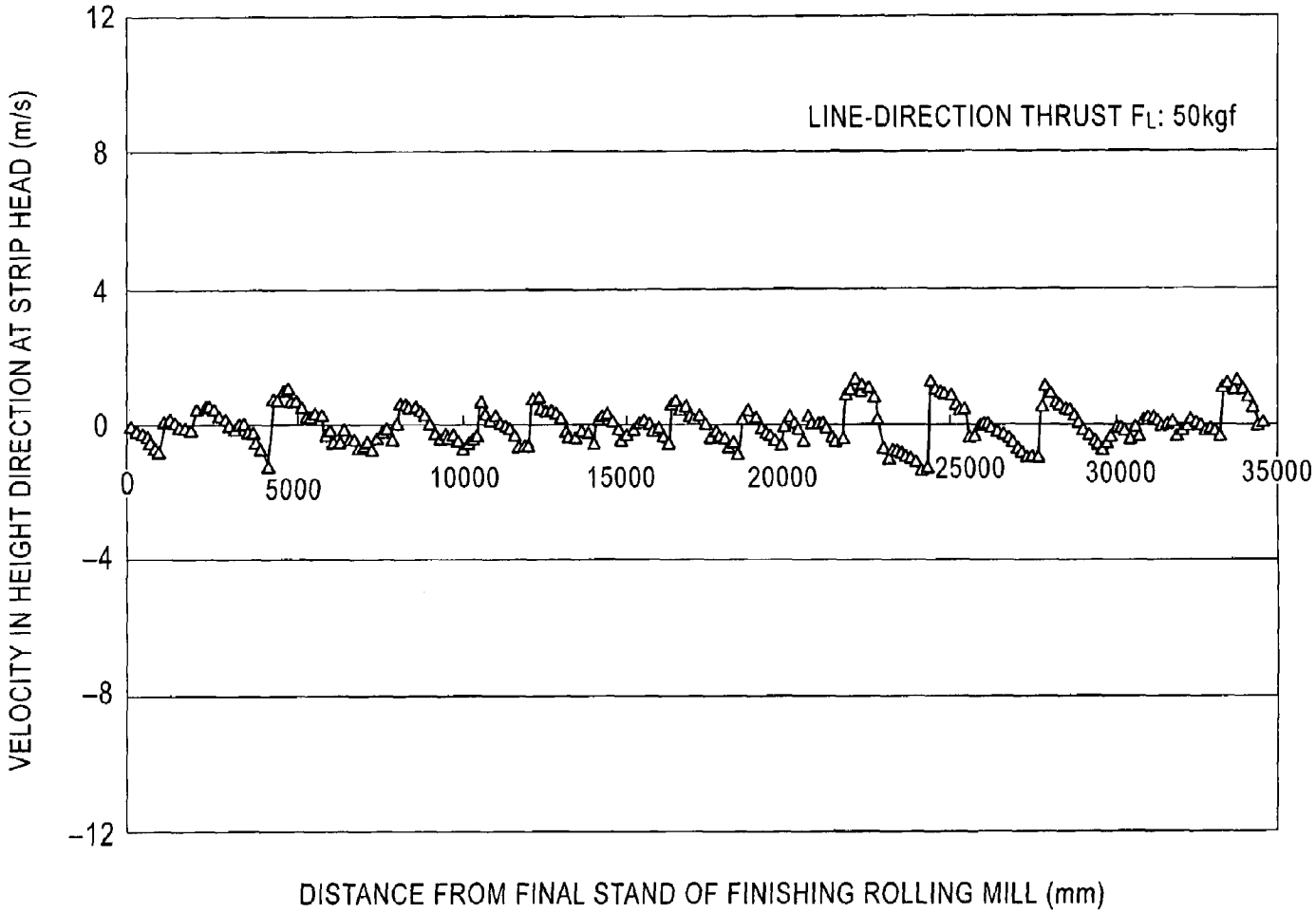
FIG. 17 is an explanatory view showing the changes in velocity in the height direction at the strip head end in another example of a simulation used in FIG. 15.
Figure 18:
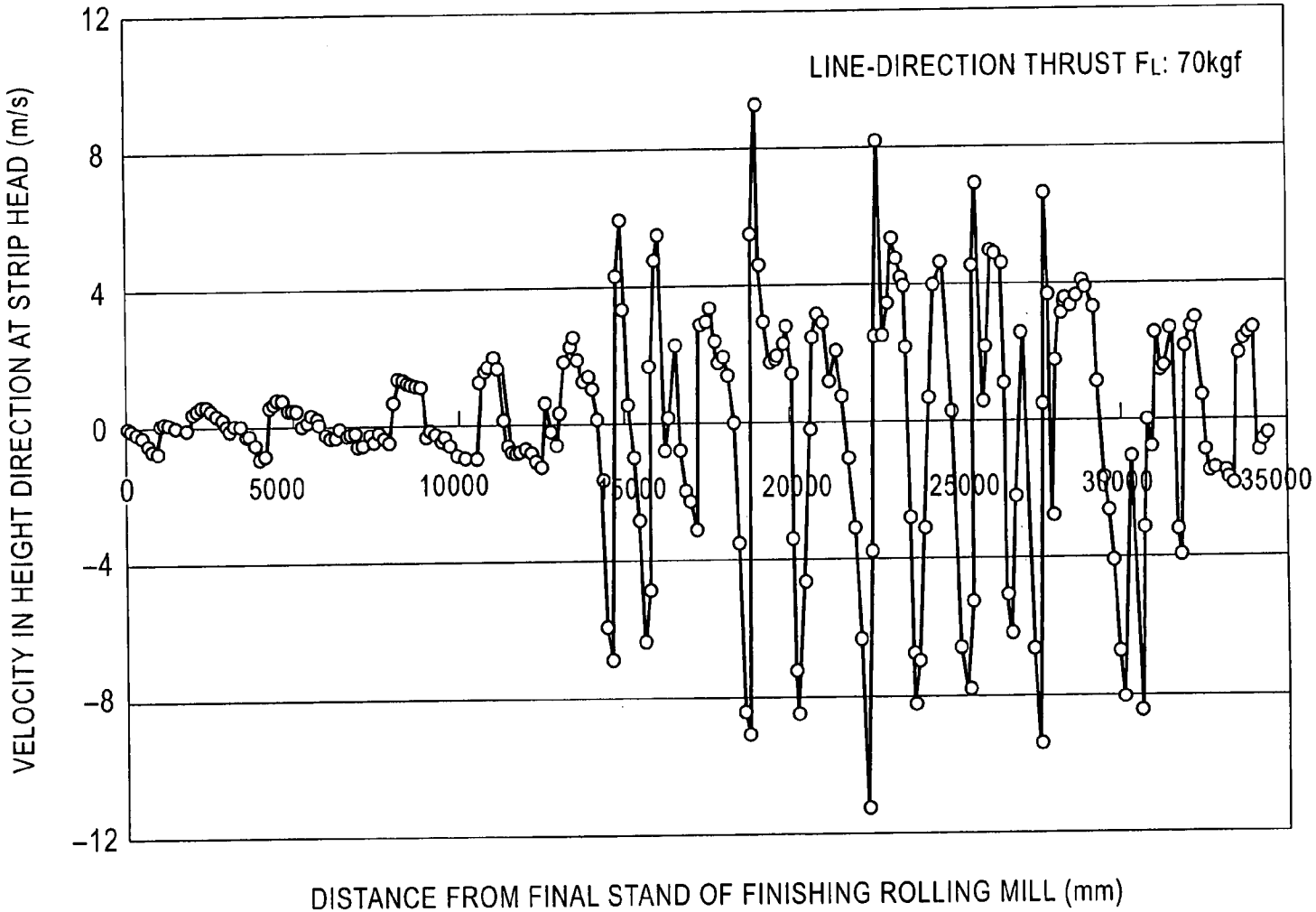
FIG. 18 is an explanatory view showing the changes in velocity in the height direction at the strip head end in a further example of a simulation used in FIG. 15.

The influence of the line-direction thrust $F_L$ on the running condition of the strip was tested in a simulation on the condition that the fluid-jet height h was fixed. In this test, the condition of jumping or waving at the head end of the strip (velocity in the height direction at the head end) was examined when the fluid-jet height h was set at 100 mm and the line-direction thrust $F_L$ was varied from 10 kgf to 90 kgf. FIG. 15 shows the test result, and FIGS. 16 to 18 show simulation results of the changes in the velocity in the height direction at the head end of the strip when the line-direction thrust $F_L$ is 30 kgf, 50 kgf, and 70 kgf. The "variation of velocity in the height direction at the head end" shown in FIG. 15 is defined by the following equation, n is 2401 (only a part is shown in FIGS. 16 to 18), and the time interval of data is 0.0125 seconds.

$$\text{Variation } \sigma^2 = \sum_{i=1}^{n} (vi - vo)^2 / n$$

wherein i: the data number vi: the velocity in the height direction at the head end of the i-th strip n: the total data number vo: the average velocity in the height direction at the head end of the strip $$vo = \sum_{i=1}^{n} vi/n \approx 0$$

FIG. 15 shows that, when the line-direction thrust $F_L$ is 50 kg or less, the variation of the velocity in the height direction velocity at the head end of the strip is extremely small, and that-the head end of the strip does not substantially jump or wave (see FIGS. 16 and 17). In contrast, when the line-direction thrust $F_L$ exceeds 50 kgf, the variation of the velocity in the height direction at the head end of the strip rapidly increases, and extremely great jumping or waving occurs at the head end of the strip (see FIG. 18). This seems because, when the line-direction thrust exceeds 50 kgf, the colliding head end of the strip strongly reacts, and thereby substantially jumps or waves. Such great jumping or waving also tends to cause a head folding defect of the strip, in a manner similar to that in the above-described sticking, and to hinder proper coiling with the coiler even if a head folding defect is not caused. The above results show that a preferable line-direction thrust $F_L$ is 50 kg or less. When the line-direction thrust $F_L$ is less than 10 kgf, a sufficient effect of pushing the displaced strip portion is not achieved.

Therefore, it is adequate to set the line-direction thrust $F_L$ within the range of 10 kg to 50 kg in order to properly suppress the displacement of the strip above the pass line and to ensure stable running of the strip.

By setting the line-direction thrust $F_L$ in this range and setting the fluid-jet height h in the above-described range, it is possible to most effectively suppress the displacement of the strip and to achieve an optimal stable running condition of the hot rolled strip.

In the present invention, the squirting position of the fluid jet 5, that is, the position of the fluid-squirting nozzle 6 may be arbitrarily determined. A required number of fluid-squirting nozzles for squirting fluid jets 5 may be provided at positions where the strip may be displaced.

Therefore, for example, when the position where a hot rolled strip 1 easily jumps or waves is clear, only one fluid-squirting nozzle 6 may be provided at the position.

When the fluid-squirting nozzles 6 are provided at a plurality of positions, for example, they may be arranged in the following manners:

(A) A plurality of fluid-squirting nozzles 6 are appropriately spaced-in the longitudinal direction of the hot runout table 3 on both widthwise sides of the hot runout table 3 (on both sides including the adjacencies of the side edges of the hot runout table 3), and the fluid-squirting nozzles 6 on both sides of the hot runout table 3 are arranged symmetrically with respect to the hot runout table.

(B) A plurality of fluid-squirting nozzles 6 are appropriately spaced in the longitudinal direction of the hot runout table 3 on both widthwise sides of the hot runout table 3 (on both sides including the adjacencies of the side edges of the hot runout table 3), and the fluid-squirting nozzles 6 on both sides of the hot runout table 3 are arranged asymmetrically with respect to the hot runout table 3 so that they are shifted from each other by a half pitch.

(C) A plurality of fluid-squirting nozzles 6 are appropriately spaced in the longitudinal direction of the hot runout table on only one widthwise side of the hot runout table 3 (at the positions on one side including the adjacency of the side edge of the hot runout table).

(D) A plurality of fluid-squirting nozzles 6 are appropriately spaced in the longitudinal direction of the hot runout table 3 above the strip pass line on the hot runout table 3.

Needless to say, the above arrangement manners (A) to (D) may be combined on one hot runout table 3.

FIGS. 19A to 19D are plan views showing the above manners (A) to (D).

Figure 19A:
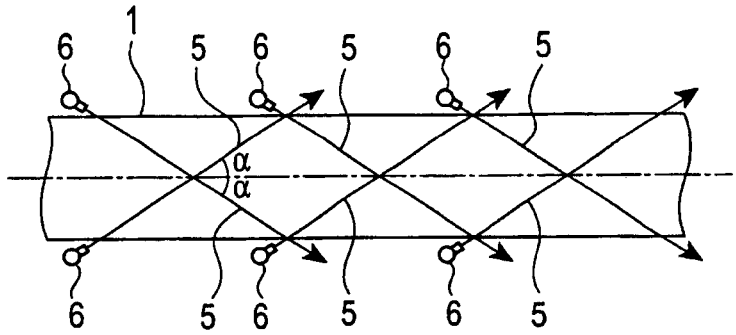
FIGS. 19A to 19D are explanatory views showing examples of squirting positions for fluid jets in the method of the present invention.

FIG. 19A shows the above manner (A). A plurality of fluid-squirting nozzles 6 are appropriately spaced in the longitudinal direction of a hot runout table 3 (not shown, the same applies hereinafter) on both widthwise sides of the hot runout table 3, and the fluid-squirting nozzles 6 on both sides of the hot runout table are arranged symmetrically with respect to the hot runout table. The angle α of the squirting direction of fluid jets 5 with respect to the longitudinal direction of the pass line (strip running direction or counter running direction) is set so that the fluid jets 5 completely pass over a hot rolled strip 1 in the widthwise direction. The fluid-squirting nozzles 6 may be provided at any positions on both widthwise sides of the hot runout table which include the adjacencies of the side edges of the hot runout table 3, and which are higher than the surface of the hot runout table.

When the fluid-squirting nozzles 6 on both widthwise sides of the hot runout table are thus arranged symmetrically with respect to the hot runout table 3, it is necessary to prevent fluid jets squirted from the fluid-squirting nozzles 6 on both sides from crossing and interfering (colliding) with each other. For that purpose, adjustments are made, for example, a difference is formed in the height of the fluid jets squirted from the fluid-squirting nozzles 6 or in the angle β with respect to the horizontal plane.

Figure 19B:
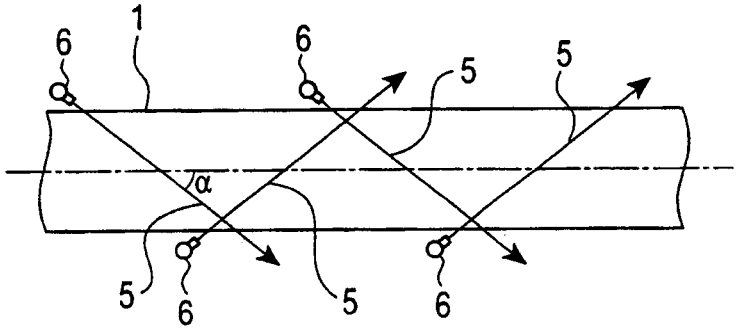

FIG. 19B shows the above manner (B). A plurality of fluid-squirting nozzles 6 are appropriately spaced in the longitudinal direction of the hot runout table 3 on both widthwise sides of the hot runout table 3, and the fluid-squirting nozzles 6 on both sides of the hot runout table are arranged asymmetrically with respect to the hot runout table 3 so that they are shifted each other by a half pitch. The angle α of the squirting direction of fluid jets 5 with respect to the longitudinal direction of the pass line (strip running direction or counter running direction) is set so that the fluid jets 5 completely pass over a hot rolled strip 1 in the widthwise direction. The fluid-squirting nozzles 6 may be provided at any positions on both widthwise sides of the hot runout table which include the adjacencies of the side edges of the hot runout table 3, and which are higher than the surface of the hot runout table.

In this manner, when the number of fluid-squirting nozzles 6 provided per unit length of the hot runout table is the same as that in the above manner (A), the interval of the fluid-squirting nozzles 6 in the longitudinal direction of the hot runout table can be reduced by half. Therefore, the densities of the fluid jets 5 passing over the hot rolled strip 1 can be increased.

Figure 19C:
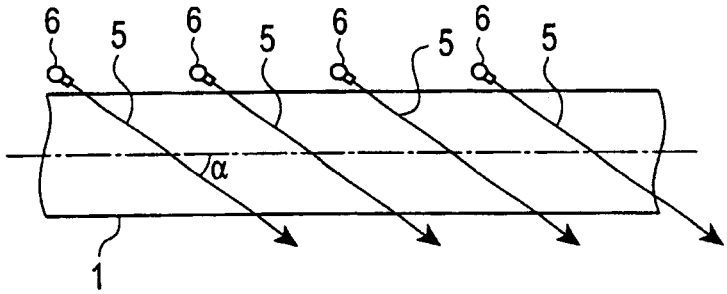

FIG. 19C shows the above manner (C). A plurality of fluid-squirting nozzles 6 are appropriately spaced in the longitudinal direction of the hot runout table 3 on only one widthwise side of the hot runout table 3. The angle α of the squirting direction of fluid jets 5 with respect to the longitudinal direction of the pass line (strip running direction or counter running direction) is set so that the fluid jets 5 completely pass over a hot rolled strip 1 in the widthwise direction. The fluid-squirting nozzles 6 may be provided at any positions on one widthwise side of the hot runout table which include the adjacency of the side edge of the hot runout table 3, and which are higher than the surface of the hot runout table.

Figure 19D:
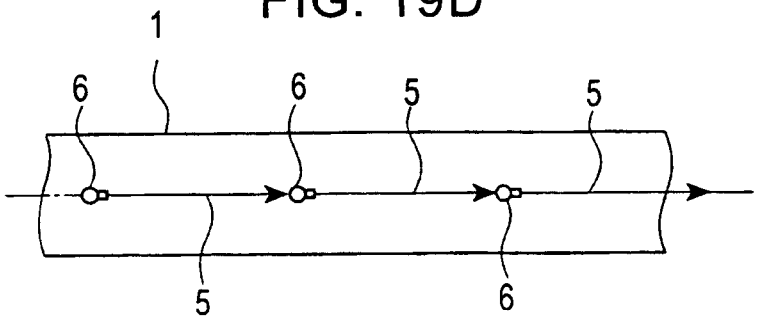

FIG. 19D shows the above manner (D). A plurality of fluid-squirting nozzles 6 are appropriately spaced in the longitudinal direction of the hot runout table 3 above the pass line on the hot runout table 3, and the squirting direction of fluid jets 5 substantially coincides with the longitudinal direction of the pass line (strip running direction or counter running direction). In this case, as shown in FIGS. 5 and 6, the fluid jets 5 may be guided toward the sides of the hot runout table 3 by setting the squirting direction of the fluid jets 5 at an angle α to the longitudinal direction of the pass line (strip running direction or counter running direction), or the fluid jets 5 may be collected by a collecting means 15 provided above the hot rolled strip on the downstream side in the squirting direction of the fluid jets 5.

Alternatively, multiple fluid-squirting nozzles 6 may be appropriately spaced in the longitudinal direction of the hot runout table on both widthwise sides of the hot runout table, and may be properly used under the control of a controller 8 so that the above manners (A) to (D) can be selectively adopted.

In the manners (A) to (D), in a case in which the squirting direction of the fluid jets 5 is at an angle α to the longitudinal direction of the pass line (strip running direction or counter running direction), when the fluid jets 5 collide with a strip portion displaced above the pass line, a thrust in the widthwise direction acts on the hot rolled strip 1, and the thrust may cause unstable running of the hot rolled strip 1, for example, snaking. Therefore, in order to prevent such unstable running, the manners (A) and (B) in which the fluid jets 5 are squirted from both widthwise sides of the hot runout table and the manner (D) in which the fluid jets 5 are squirted in the substantially longitudinal direction of the pass line above the pass line are more preferable than the manner (C) in which the fluid jets 5 are squirted from only one widthwise side of the hot runout table.

In the manners (A) and (B) in which the fluid jets 5 are squirted from both widthwise sides of the hot runout table, in order to more reliably prevent unstable running due to the thrust in the strip widthwise direction that is applied to the hot rolled strip 1 by the collision with the fluid jets 5, it is preferable that fluid jets be squirted from the positions opposing across the hot runout table (including the positions that are asymmetric with respect to the hot runout table) so that the fluid jets 5 passing over the hot rolled strip are substantially equal in widthwise thrust $F_W$ that is defined by the following equation (2):

$$F_W=[\rho A(v\sin(\pi\times\alpha/180))^2]/9.8 \quad (2)$$

wherein

ρ: the density of the fluid that forms the fluid jet ($kg/m^3$)

A: the cross-sectional area of the aperture of the fluid-squirting nozzle ($m^2$)

v: the velocity of the fluid jet (m/sec)

α: the angle of the squirting direction of the fluid jets with respect to the pass-line longitudinal direction strip running direction or counter running direction (°)

Hence, when the fluid jets 5 squirted from both widthwise sides of the hot runout table collide with a strip portion displaced above the pass line, the thrusts acting on the strip widthwise direction because of the collision are balanced. Therefore, it is possible to more reliably prevent unstable running of the hot rolled strip 1.

Figure 20:
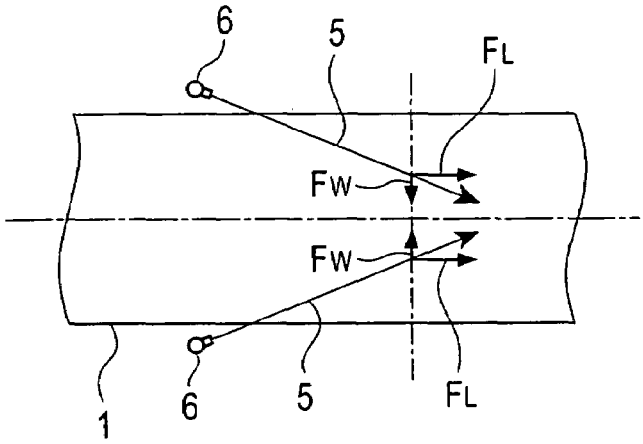
FIG. 20 is an explanatory view showing the widthwise thrusts $F_W$ that are applied to the strip by fluid jets squirted from both widthwise sides of the hot runout table in the method of the present invention.

While FIG. 20 illustrates the manner (A) (FIG. 19A) as an example, this also applies to the fluid jets 5 squirted from the positions opposing asymmetrically with respect to the hot runout table, as in the manner (B) (FIG. 19B).

It is difficult to predict where a phenomenon in which a strip portion is displaced above the pass line on the hot runout table (e.g., jumping or waving) will occur in the longitudinal direction of the hot runout table. For this reason, in order to cope with the displacement of a strip portion caused at any position, it is preferable that the regions in which the fluid jets 5 pass above the strip be consecutively provided in the strip longitudinal direction. That is, preferably, as shown in FIG. 21A, fluid jets 5 are squirted at a plurality of positions appropriately spaced in the longitudinal direction of the hot runout table (for example, see FIGS. 19A to 19D), and, ends of jet pass lines x and x adjacent in the pass-line longitudinal direction (that is, ends of $x_1$ and $x_2$, ends of $x_2$ and $x_3$, . . . ), of imaginary jet pass lines x obtained by projecting the paths of the fluid jets 5 passing over the hot rolled strip 1 in the widthwise direction onto the surface of the hot rolled strip, correspond with each other (that is, the ends are aligned) or overlap in the pass-line longitudinal direction. In this embodiment, the head end of the jet pass line $x_2$ overlaps with the tail end of the jet pass line $x_3$ by a length y. The interval and fluid-squirting direction of a plurality of fluid-squirting nozzles 6 appropriately spaced in the longitudinal direction of the hot runout table are determined so that the above form can be achieved. When the fluid jets 5 are squirted over the hot rolled strip 1, as described above, they can reliably collide with a displaced strip portion wherever the strip portion is displaced in the longitudinal direction of the hot runout table. While FIG. 21A illustrates the above manner (C), this also applies to the other manners (A), (B), and (D).

When fluid jets are squirted at a plurality of positions appropriately spaced in the longitudinal direction of the hot runout table, the interval of the squirting positions of the fluid jets (interval of the installation positions of the fluid-squirting nozzles) is not particularly limited. In order to carry out the manner shown in FIG. 21A, it is preferable that the interval be normally within the range of 5 m to 15 m, more preferably, approximately 5 m to 12 m.

Figure 21B:
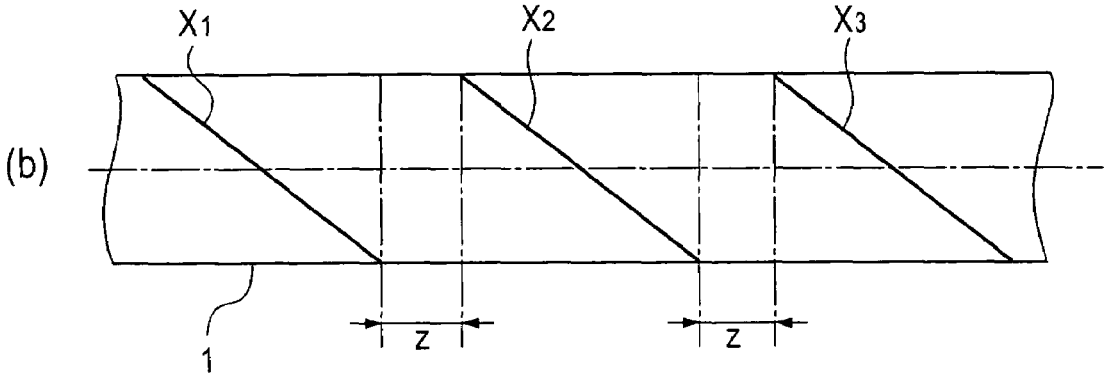

FIG. 21B shows an embodiment in which ends of jet pass lines x and x adjacent in the pass-line longitudinal direction (that is, ends of $x_1$ and $x_2$, ends of $x_2$ and $X_3$, . . . ), of imaginary jet pass lines x obtained by projecting the paths of the fluid jets 5 passing over the hot rolled strip 1 in the widthwise direction onto the surface of the hot rolled strip, do not correspond or overlap with each other in the pass-line longitudinal direction. In this case, it is preferable to set the distance z between the ends of the jet pass lines x and x at 5 m or less. This is because the displacement, such as jumping, of a strip portion, in general, frequently occurs again after it is corrected (eliminated) by collision with the fluid jets 5 and the strip further runs 5 m or more.

Figure 22:
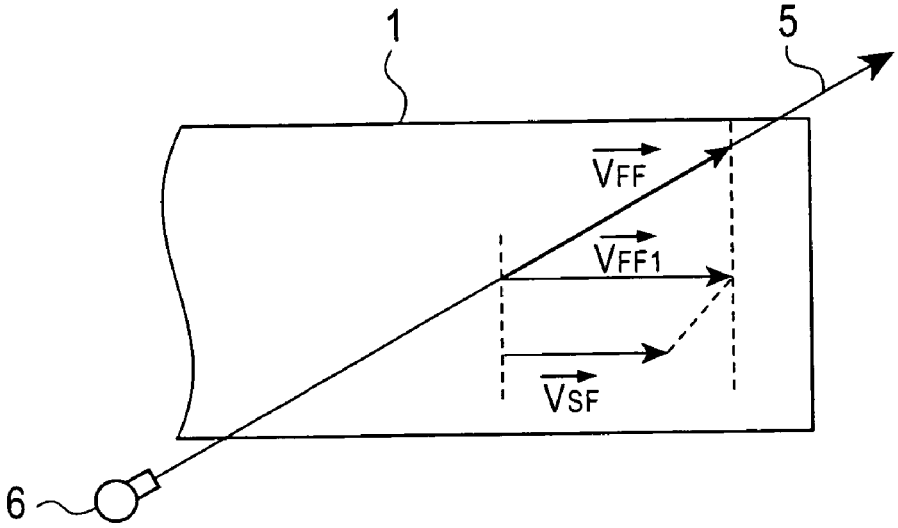
FIG. 22 is an explanatory view showing the relationship between the flow velocity of a fluid jet squirted in the strip running direction, and the running velocity of the head end of a strip.
Figure 23:
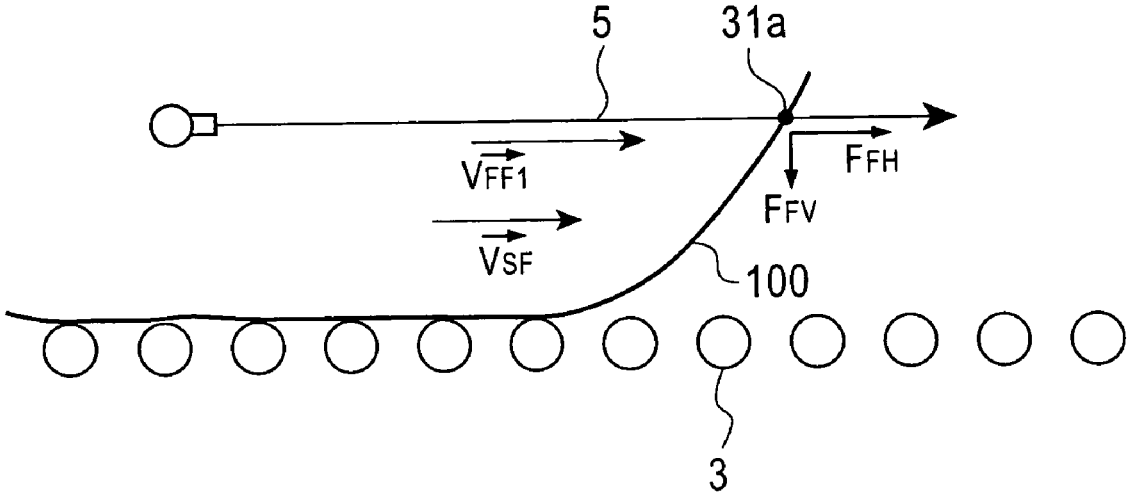
FIG. 23 is an explanatory view showing the force applied when a fluid jet squirted in the strip running direction collides with the head end of a strip displaced above the pass line.

In the present invention, when a fluid jet 5 is squirted in the strip running direction, that is, the fluid jet 5 is squirted so that the angle $\alpha$ with respect to the strip running direction satisfies the condition $0° \leqq \alpha < 90°$, it is preferable that a velocity component in the pass-line longitudinal direction of the fluid jet 5 passing above the hot rolled strip be higher than the running velocity of the hot rolled strip 1. It is particularly effective to set a velocity component in the pass-line longitudinal direction of a fluid jet 5 passing above the head end of the hot rolled strip 1 higher than the running velocity of the hot rolled strip 1. That is, when it is assumed that the running velocity of the hot rolled strip 1 is VSF (vector) and the flow velocity of the fluid jet 5 is VFF (vector), as shown in FIG. 22, the absolute value of a component VFF1 of the flow velocity VFF of the fluid jet 5 in the pass-line longitudinal direction (strip running direction) is set to be larger than the absolute value of the running velocity VSF of the hot rolled strip 1. In this case, as shown in FIG. 23, when a strip portion 100 displaced upward from the pass line (jumping at the head end of the strip) collides with the fluid jet 5 (a collision point 31*a* in the figure), a thrust FFH (vector) in the strip running direction and a pressing force FFV (vector) in the vertically downward direction act on the strip portion 100. This also applies to a case in which the strip portion 100 waves. These acting forces applied to the strip portion 100 eliminate jumping and waving in the processes described above with reference to FIGS. 10 and 11.

Figure 24:
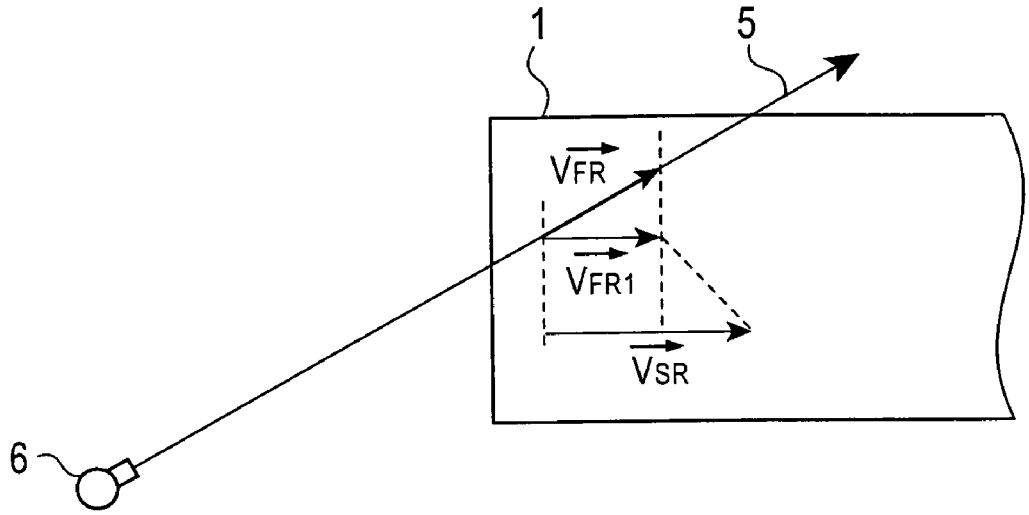
FIG. 24 is an explanatory view showing the relationship between the flow velocity of a fluid jet squirted in the strip running direction, and the running velocity of the tail end of a strip.
Figure 25:
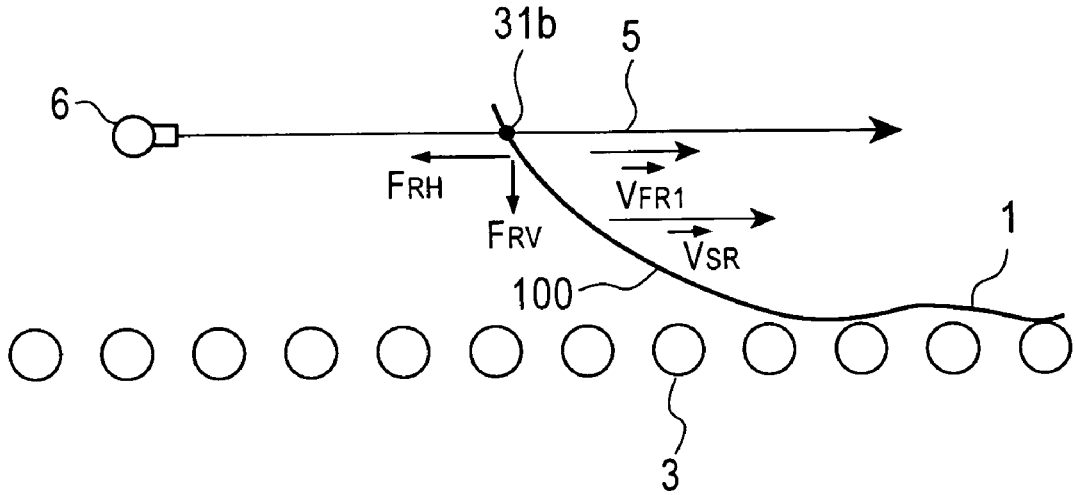
FIG. 25 is an explanatory view showing the force applied when a fluid jet squirted in the strip running direction collides with the tail end of a strip displaced above the pass line.

In the present invention, when a fluid jet 5 is squirted above the tail end of the hot rolled strip 1, that is, when the fluid jet 5 is squirted so that the angle $\alpha$ with respect to the strip running direction satisfies the condition $0° \leqq \alpha < 90°$ and the fluid jet 5 is squirted above the tail end of the hot rolled strip 1, it is preferable that a velocity component in the pass-line longitudinal direction of the fluid jet 5 passing above the tail end of the hot rolled strip 1 be lower than the running velocity of the hot rolled strip 1. That is, when it is assumed that the running velocity of the hot rolled strip 1 while the tail end of the strip is passing on the hot runout table is VSR (vector) and the flow velocity of the fluid jet 5 is VFR (vector), as shown in FIG. 24, the absolute value of a component VFR1 of the flow velocity VFF of the fluid jet 5 in the pass-line longitudinal direction (strip running direction) is set to be smaller than the absolute value of the running velocity VSR of the hot rolled strip 1. In this case, as shown in FIG. 25, when a strip portion 100 displaced upward from the pass line (jumping at the tail end of the strip) collides with the fluid jet 5 (a collision point 31*b* in the figure), a resistant force FRH (vector) in a direction opposite to the strip running direction and a vertically downward pressing force FRV (vector) act on the strip portion 100. This also applies to a case in which the strip portion waves.

Figure 26:
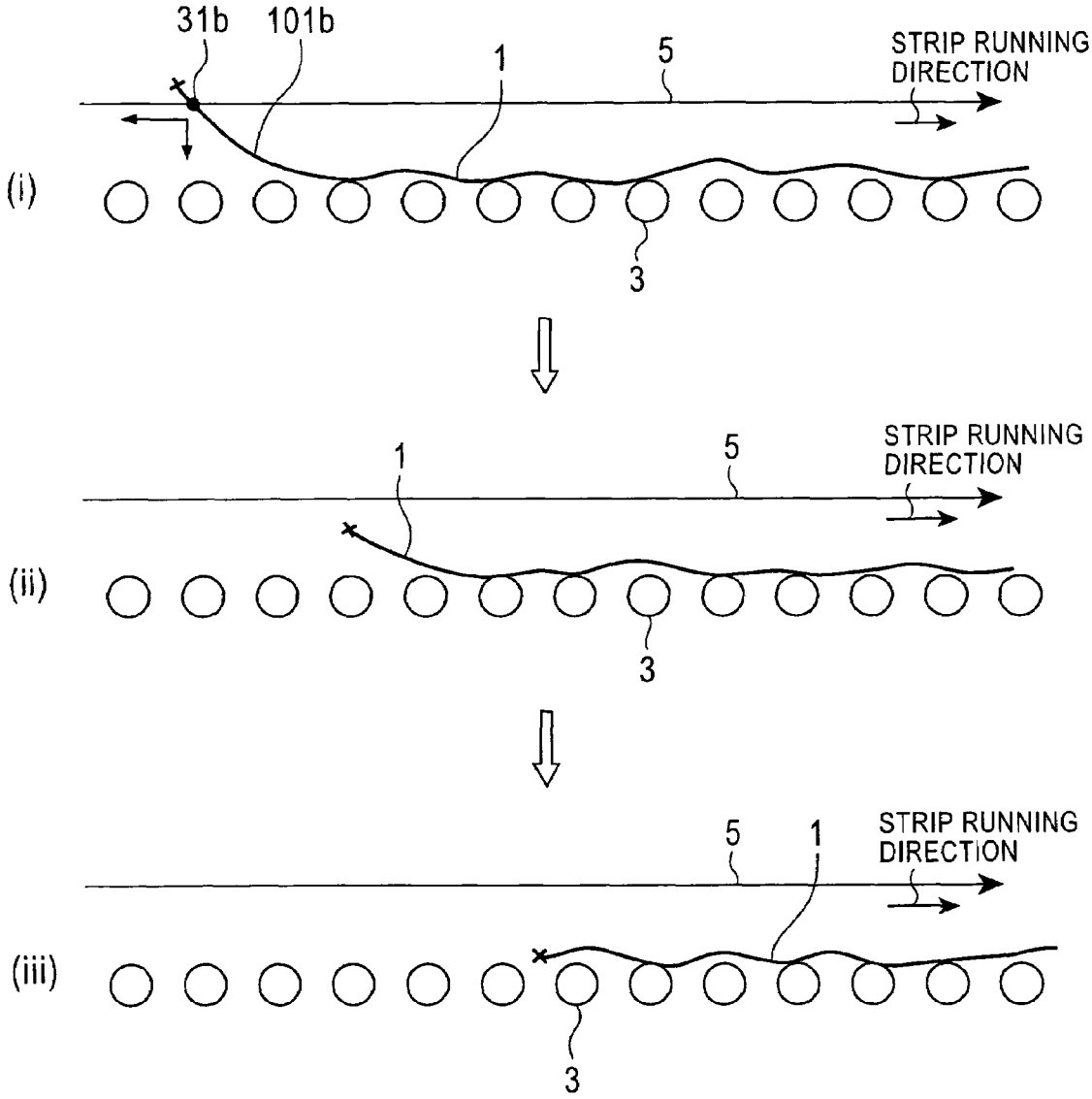
FIG. 26 is an explanatory view showing a process in which jumping at the tail end of a strip is eliminated by the action of the fluid jet shown in FIG. 25.

FIG. 26 shows a process in which jumping at the tail end of the strip is eliminated by the above fluid jet 5. Herein, the fluid jet 5 is squirted from the fluid-squirting nozzle 6 in the strip running direction (the angle $\alpha$ defined between the fluid jet 5 and the strip running direction: $0° \leqq \alpha < 90°$) under the conditions of the present invention before jumping 101*b* becomes large. When the jumping 101*b* increases in size in this state, it collides with the fluid jet 5 (see FIG. 26(*i*)), and a substantially horizontal impact force acts on a collision point 31*b* near the top of the jumping 101*b* because of the fluid jet 5. The impact force acts as a pass-line longitudinal component (a component for pushing the jumping 101*b* in the counter running direction) and a vertical component (a component for pushing the jumping 101*b* toward the pass line). As a result, as shown in FIG. 26(*ii*), the jumping 101*b* is pushed out in the counter running direction while moving in the strip running direction, and the peak point is shifted down. Consequently, the increase in size of the jumping 101*b* is suppressed, and the jumping 101*b* is finally eliminated, as shown in FIG. 26(*iii*), so that a stable running state is brought about. Since the fluid jet 5 flows so as to completely pass over the hot rolled strip 1 at a predetermined height, it does not touch a strip portion that is running therebelow, and does not push a strip portion, which is normally running, between the table rolls of the hot runout table 3. For this reason, it is possible to reliably and effectively suppress and eliminate jumping.

Figure 27:
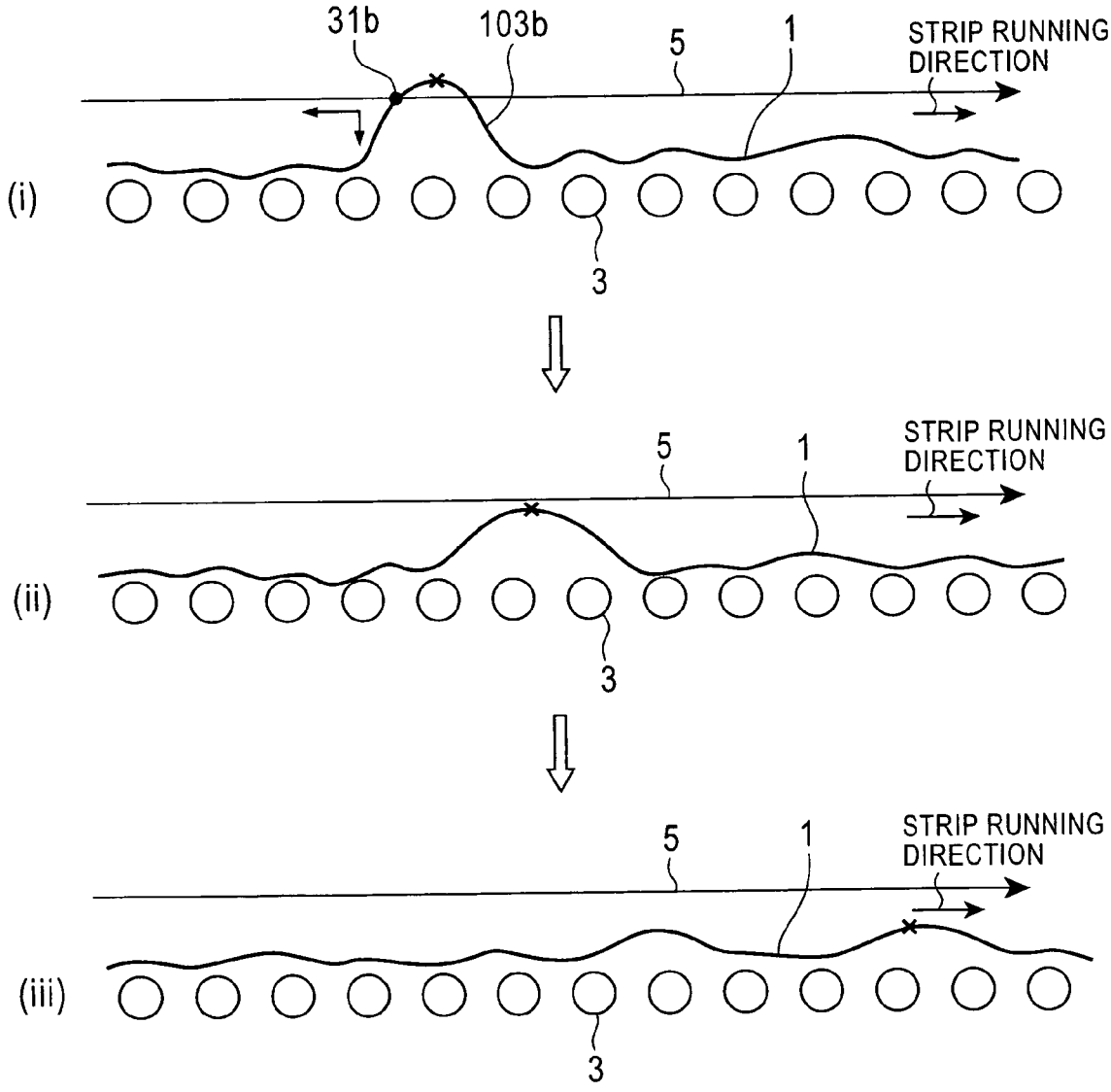
FIG. 27 is an explanatory view showing a process in which waving at the tail end of a strip is eliminated by the action of the fluid jet shown in FIG. 25.

FIG. 27 shows a process in which waving at the tail end of the strip is eliminated by the above-described fluid jet 5. Herein, the fluid jet 5 is squirted from the fluid-squirting nozzle 6 in the strip running direction (the angle $\alpha$ defined between the fluid jet 5 and the strip running direction: $0° \leqq \alpha < 90°$) under the conditions of the present invention before waving 103*b* becomes large. When the waving 103*b* increases in size in this state, it collides with the fluid jet 5 (see FIG. 27(*i*)), and a substantially horizontal impact force acts on a collision point 31*b* near the top of the waving 103*b* because of the fluid jet 5. The impact force acts as a pass-line longitudinal component (a component for pushing the waving 103*b* in the counter running direction) and a vertical component (a component for pushing the waving 103*b* toward the pass line). As a result, as shown in FIG. 27(*ii*), the waving 103*b* is pushed out in the counter running direction while moving in the strip running direction, and the peak point is shifted down. Consequently, the increase in size of the waving 103*b* is suppressed, and the waving 103*b* is finally eliminated, as shown in FIG. 27(*iii*), so that a stable running state is brought about. Since the fluid jet 5 flows so as to completely pass over the hot rolled strip 1 at a predetermined height, it does not touch a strip portion that is running therebelow, and does not push a strip portion, which is normally running, between the table rolls of the hot runout table 3. For this reason, it is possible to reliably and effectively suppress and eliminate waving.

From the above, in order to carry out the present invention, it is preferable that the pass-line longitudinal velocity component of the fluid jet 5 passing above the head end of the hot rolled strip 1 be higher than the running velocity of the hot rolled strip 1, and that the pass-line longitudinal velocity component of the fluid jet 5 passing above the tail end of the hot rolled strip 1 be lower than the running velocity of the hot rolled strip 1.

The above-described pass-line direction components of velocity VFF1 and VFR1 of the fluid jet 5 can be controlled, for example, by adjusting the flow velocities VFF and VFR while changing the opening degree of the flow-rate adjustment valve 12 shown in FIG. 8. Alternatively, the adjustment may be made by changing the squirting angle $\alpha$ of the fluid jet 5 with the angle adjustment mechanism 14.

While the timing and period of squirting the fluid jet 5 above the hot rolled strip 1 in the present invention are not particularly limited, there is a constant possibility that unordinary displacement of the strip, such as jumping or waving, will occur while the hot rolled strip 1 is running on the hot runout table on free tension, as described above. Therefore, it is preferable to squirt the fluid jet 5 while the hot rolled strip 1 is running on the hot runout table on free tension, in other words, while the head end and tail end of the hot rolled strip are passing on the hot runout table.

Regarding the squirting timing of fluid jets 5, the fluid jets 5 may be sequentially squirted from a squirting position (fluid-squirting nozzle 6) nearest the final stand 2 of the hot finishing rolling mill correspondingly to the passage of the head end or tail end of a hot rolled strip 1. However, it is the easiest and reliably effective to simultaneously squirt fluid jets 5 from all the squirting positions, as long as there is no problem with the amount of fluid to be supplied.

When the amount of fluid to be supplied is limited, or, for example, when only jumping is to be suppressed and eliminated, fluid jets 5 may be sequentially squirted from a squirting position nearest the final stand 2 of the hot finishing rolling mill correspondingly to the passage of the head end or tail end of a hot rolled strip 1, and squirting of the fluid jets 5 may be sequentially stopped immediately after the passage.

It is preferable that the fluid jet 5 reach as far as possible with the same cross-sectional shape without being diffused. From this viewpoint, it is preferable that the flow velocity of the fluid jet 5 at the leading end of the nozzle be 30 m/sec or more. Since the strip running velocity is approximately 10 m/sec in a typical hot rolling line, the flow velocity of the fluid jet 5 is almost three times the strip running velocity or more.

The hot rolled strip 1 conveyed on the hot runout table is cooled by supplying cooling water thereto. The flow velocity of the fluid jet 5 may be decreased by cooling water that is supplied from above. In order to prevent this, it is preferable that a shield for shielding the fluid jet 5 from the cooling water be provided above the fluid jet.

The shield may be, for example, (a) a shielding member provided above the fluid jet 5, or (b) a shielding fluid jet flowing substantially parallel to and above the fluid jet 5. In the latter case, a shielding-fluid squirting nozzle is used to squirt a shielding fluid jet substantially parallel to and above the fluid jet 5.

Figure 28:
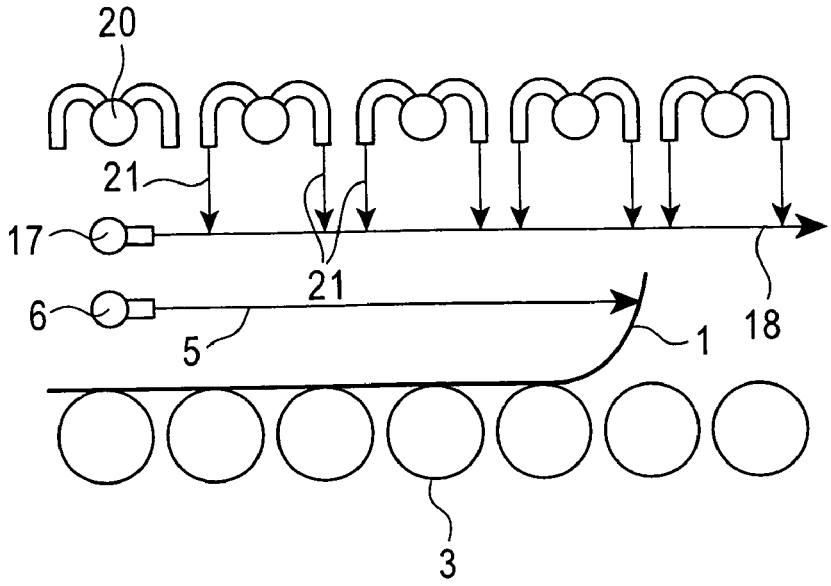
FIG. 28 is a side view showing an embodiment in which a shielding fluid jet is provided above a fluid jet in the method of the present invention.
Figure 29:
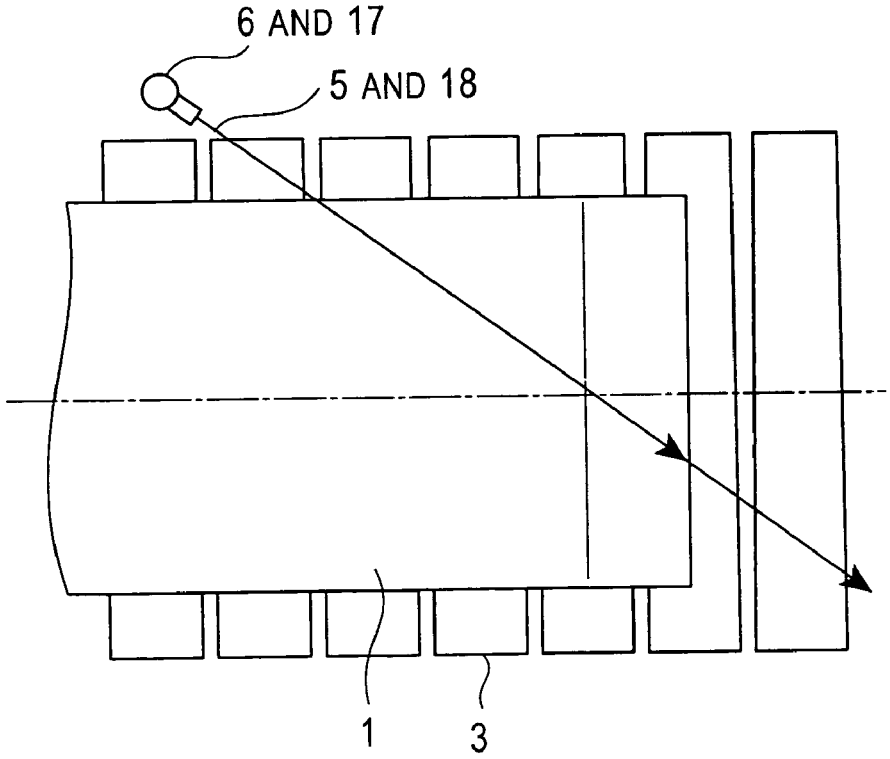
FIG. 29 is a plan view showing the embodiment shown in FIG. 28.

FIGS. 28 and 29 are a side view and a plan view, respectively, showing an example of the above (b).

In the figures, laminar heads 20 supply cooling water 21 to a running hot rolled strip 1 from above a hot runout table 3. A second fluid-squirting nozzle 17 is provided above a fluid-squirting nozzle 6 to squirt a shielding fluid jet 18 substantially parallel to and right above a fluid jet 5 in order to shield the fluid jet 5 from the cooling water 21 supplied from the laminar heads 20.

When the shielding fluid jet 18 is squirted from the second fluid-squirting nozzle 17 right above the fluid jet 5 squirted from the fluid-squirting nozzle 6, the cooling water 21 jetted from the laminar heads 20 is shielded by the shielding fluid jet 18, but does not directly collide with the fluid jet 5. Therefore, the flow velocity of the fluid jet 5 is prevented from being decreased.

Fluid jets 18 may be squirted from a plurality of positions vertically arranged above the fluid jet 5, or may be squirted in a parallel form in accordance with the squirt width of the fluid jet 5.

Since the fluid jet 5 and the shielding fluid jet 18 flowing right thereabove are almost the same as a fluid jet, the shielding fluid jet 11 can contribute to stable running, like the fluid jet 5, by being squirted on the conditions of the present invention.

Figure 30:
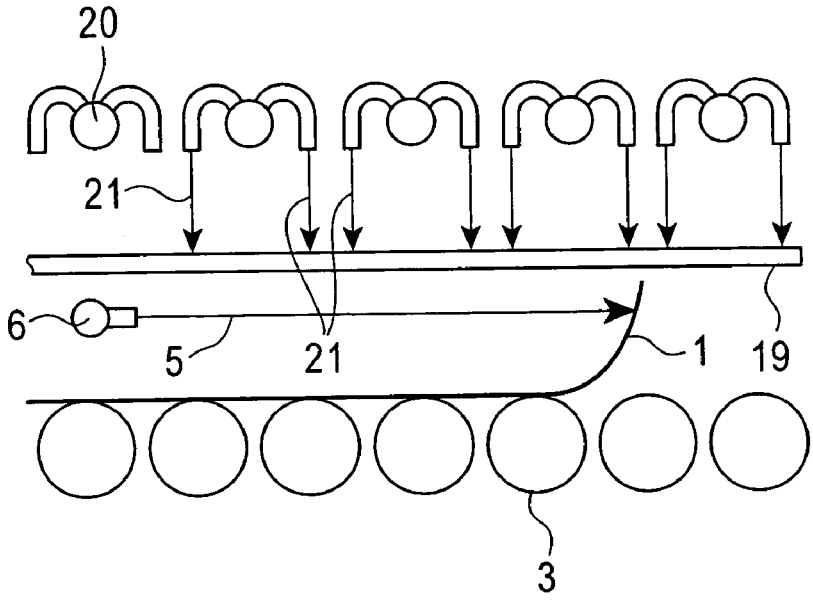
FIG. 30 is a side view showing an embodiment in which a shielding plate is provided above a fluid jet in the method of the present invention.
Figure 31:
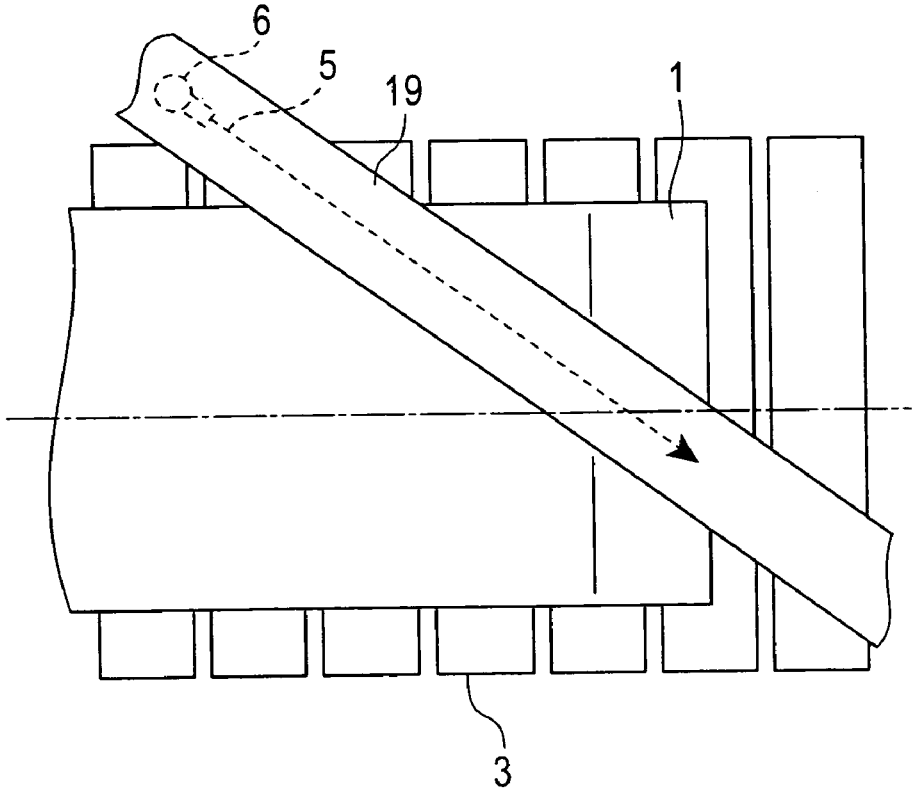
FIG. 31 is a plan view showing the embodiment shown in FIG. 30.

FIGS. 30 and 31 are a side view and a plan view, respectively, showing an example of the above (a).

In the figures, a shielding plate 19 is provided right above a fluid jet 5 squirted from a fluid-squirting nozzle 6 to shield the fluid jet 5 from cooling water 21 supplied from laminar heads 20. When this shielding plate 19 is provided, the cooling water 21 jetted from the laminar heads 20 is shielded by the shielding plate 19, and therefore, it does not directly collide with the fluid jet 5. This prevents the flow velocity of the fluid jet 5 from being decreased.

When the shielding plate 19 is horizontally movable, and a relatively thick hot rolled strip is produced without using the fluid jet 5, the shielding plate 19 may be moved from above the hot runout table 3.

While the preferred embodiments of the present invention have been described above, unordinary displacement, such as jumping or waving, of a strip on the hot runout table remarkably occurs in thin hot rolled strips having a thickness of 2.0 mm or less, and therefore, the present invention is particularly suited to produce such thin hot rolled strips.

INDUSTRIAL APPLICABILITY

The present invention provides a production method and production system for producing a hot rolled strip in a hot rolling line. According to the present invention, it is possible to ensure stable running of a hot rolled strip on a hot runout table and to prevent excessive displacement of the strip above a pass line and a head or tail folding defect of the strip resulting from the displacement.

The invention claimed is:

1. A hot-rolled-strip production method wherein a hot rolled strip obtained by rolling with a hot rolling mill is conveyed by a hot runout table, and is coiled with a coiler, the production method comprising:

squirting a fluid jet above the hot rolled strip conveyed by the hot runout table so as to pass over the hot rolled strip without touching a surface of any portion of the hot rolled strip when the hot rolled strip is running entirely on a pass line;

wherein when a portion of the strip is displaced upward from the pass line beyond a predetermined level, the displaced portion of the strip collides with the fluid jet in order to correct displacement of the displaced portion.

2. The hot-rolled-strip production method according to claim 1, wherein a height of a center line of the fluid jet, passing over the hot rolled strip, from the pass line is within a range of 50 mm to 450 mm.

3. The hot-rolled-strip production method according to claim 1, wherein a height of a center line of the fluid jet, passing over the hot rolled strip, from the pass line is more than or equal to 50 mm and less than 200 mm.

4. The hot-rolled-strip production method according to any one of claims 1 to 3, wherein a line-direction thrust $F_L$ of the fluid jet passing above the hot rolled strip is defined by equation (1), and is set to be within a range of 10 kgf to 50 kgf:

$$F_L=[\rho A(v\cos(\pi\times\alpha/180)-u)^2]/9.8 \quad (1)$$

wherein

ρ: a density of fluid that forms the fluid jet (kg/m$^3$)

A: a cross-sectional area of an aperture of a fluid-squirting nozzle (m$^2$)

v: a velocity of the fluid jet (m/sec)

u: a running velocity of the hot rolled strip (m/sec)

α: an angle of a squirting direction of the fluid jet with respect to a strip running direction (°).

5. The hot-rolled-strip production method according to any one of claims 1 to 3, wherein the fluid jet is squirted at an angle α to a strip running direction, and the angle α satisfies $0°\leqq\alpha<90°$.

6. The hot-rolled-strip production method according to claim 5, wherein a velocity component in a longitudinal direction of the pass line of the fluid jet passing above the hot rolled strip is higher than a running velocity of the hot rolled strip.

7. The hot-rolled-strip production method according to claim 5, wherein a velocity component in a longitudinal direction of the pass line of the fluid jet passing above a head end of the hot rolled strip is higher than a running velocity of the hot rolled strip, and a velocity component in the longitudinal direction of the pass line of the fluid jet passing above a tail end of the hot rolled strip is lower than the running velocity of the hot rolled strip.

8. The hot-rolled-strip production method according to any one of claims 1 to 3, wherein the fluid jet is squirted at an angle α to a counter strip running direction, and the angle α satisfies $0°\leqq\alpha<90°$.

9. The hot-rolled-strip production method according to any one of claims 1 to 3, wherein the fluid jet is squirted at a head end of the hot rolled strip at an angle α to a strip running direction, and the angle α satisfies $0°\leqq\alpha<90°$, and wherein the fluid jet is squirted at a tail end of the hot rolled strip at an angle α to a counter running direction, and the angle α satisfies $0°\leqq\alpha<90°$.

10. The hot-rolled-strip production method according to any one of claims 1 to 3, wherein squirting of the fluid jet is performed at a plurality of positions appropriately spaced in a longitudinal direction of the hot runout table.

11. The hot-rolled-strip production method according to claim 10, wherein an interval between the fluid-jet squirting positions in the longitudinal direction of the hot runout table is within a range of 5 m to 15 m.

12. The hot-rolled-strip production method according to any one of claims 1 to 3, wherein the fluid jet is allowed to completely pass over the hot rolled strip in a widthwise direction by setting an angle α of a squirting direction of the fluid jet with respect to a strip running direction or a counter running direction so as to satisfy $0°\leqq\alpha<90°$.

13. The hot-rolled-strip production method according to claim 12, wherein squirting of the fluid jet is performed at a plurality of positions appropriately spaced in a longitudinal direction of the hot runout table, and wherein imaginary jet pass lines x are obtained by projecting, onto the surface of the hot rolled strip, paths of fluid jets that completely pass over the hot rolled strip in the widthwise direction, and ends of jet pass lines x and x adjacent in a longitudinal direction of the pass line, of the imaginary jet pass lines x, correspond or overlap with each other in the longitudinal direction of the pass line.

14. The hot-rolled-strip production method according to any one of claims 1 to 3, wherein squirting of the fluid jet is performed on both widthwise sides of the hot runout table, and fluid jets that are squirted at positions opposing across the hot runout table, including positions that are asymmetrically provided with respect to the hot runout table, and that pass over the hot rolled strip are substantially equal in a widthwise thrust $F_w$ defined by equation (2):

$$F_w=[\rho A(v\sin(\pi\times\alpha/180))^2]/9.8 \quad (2)$$

wherein

ρ: a density of fluid that forms the fluid jet (kg/m$^3$)

A: a cross-sectional area of an aperture of a fluid-squirting nozzle (m$^2$)

v: a velocity of the fluid jet (m/sec)

α: an angle of a squirting direction of the fluid jets with respect to the longitudinal direction of the pass line (°).

15. The hot-rolled-strip production method according to any one of claims 1 to 3, wherein the fluid jet passes above the hot rolled strip in a longitudinal direction of the pass line, and is collected above the hot rolled strip on a downstream side in a squirting direction of the fluid jet.

16. The hot-rolled-strip production method according to any one of claims 1 to 3, wherein a squirting direction of the fluid jet is inclined upward or downward with respect to a horizontal plane, and an inclination angle β of the squirting direction of the fluid jet with respect to the horizontal plane is 10° or less.

17. The hot-rolled-strip production method according to any one of claims 1 to 3, wherein the hot rolled strip conveyed by the hot runout table is cooled by cooling water supplied from above, and a shield for shielding the fluid jet from the cooling water is provided above the fluid jet.

18. The hot-rolled-strip production method according to claim 17, wherein the shield is a shielding member provided above the fluid jet.

19. The hot-rolled-strip production method according to claim 17, wherein the shield is a shielding fluid jet that flows substantially parallel to and above the fluid jet.

20. A hot-rolled-strip production system comprising:

a hot rolling train;

a hot runout table provided on an exit side of the hot rolling train to convey a hot rolled strip;

a coiler for coiling the hot rolled strip conveyed by the hot runout table; and a fluid-squirting nozzle provided adjacent to or above the hot runout table to squirt a fluid jet above the hot rolled strip conveyed by the hot runout table so that the fluid jet passes over the hot rolled strip without touching a surface of any portion of the hot rolled strip when the hot rolled strip is running entirely on a pass line, wherein a height of a center of a nozzle aperture of the fluid-squirting nozzle from the pass line is within a range of 50 mm to 450 mm.

21. The hot-rolled-strip production system according to claim 20, wherein the height of the center of the nozzle aperture of the fluid-squirting nozzle from the pass line is more than or equal to 50 mm and less than 200 mm.

22. The hot-rolled-strip production system according to claim 20 or 21, wherein an angle of $\alpha$ a squirting direction of the fluid jet from the fluid-squirting nozzle with respect to a strip running direction satisfies $0° \leqq \alpha < 90°$.

23. The hot-rolled-strip production system according to claim 20 or 21, wherein an angle $\alpha$ of a squirting direction of the fluid jet from the fluid-squirting nozzle with respect to a counter running direction satisfies $0° \leqq \alpha < 90°$.

24. The hot-rolled-strip production system according to claim 20 or 21, wherein the fluid-squirting nozzle includes a first fluid-squirting nozzle member that allows an angle $\alpha$ of a squirting direction of the fluid jet with respect to a strip running direction to satisfy $0° \leqq \alpha < 90°$, and a second fluid-squirting nozzle member that allows an angle $\alpha$ of a squirting direction of the fluid jet with respect to a counter running direction to satisfy $0° \leqq \alpha < 90°$.

25. The hot-rolled-strip production system according to claim 20 or 21, wherein the fluid-squirting nozzle includes a plurality of fluid-squirting nozzle members appropriately spaced in a longitudinal direction of the hot runout table.

26. The hot-rolled-strip production system according to claim 25, wherein an interval between the fluid-squirting nozzle members in the longitudinal direction of the hot runout table is within a range of 5 m to 15 m.

27. The hot-rolled-strip production system according to claim 20 or 21, wherein an angle $\alpha$ of a squirting direction of the fluid jet from the fluid-squirting nozzle with respect to a strip running direction or a counter running direction satisfies $0° \leqq \alpha < 90°$, and the fluid jet squirted from the fluid-squirting nozzle completely passes over the hot rolled strip in a widthwise direction.

28. The hot-rolled-strip production system according to claim 27, wherein the fluid-squirting nozzle includes a plurality of fluid-squirting nozzle members appropriately spaced in a longitudinal direction of the hot runout table, imaginary jet pass lines x are obtained by projecting, onto the surface of the hot rolled strip, paths of fluid jets that completely pass over the hot rolled strip in the widthwise direction, and an interval and squirting direction of the fluid-squirting nozzle members are determined so that ends of jet pass lines x and x adjacent in a longitudinal direction of the pass line, of the imaginary jet pass lines x, correspond or overlap with each other in the longitudinal direction of the pass line.

29. The hot-rolled-strip production system according to claim 20 or 21, wherein the fluid-squirting nozzle is provided above the pass line so that the squirted fluid jet passes above the hot rolled strip in a longitudinal direction of the pass line, and collecting means for collecting the fluid jet is provided above the pass line on a downstream side in a squirting direction of the fluid jet.

30. The hot-rolled-strip production system according to claim 20 or 21, wherein a squirting direction of the fluid jet from the fluid-squirting nozzle is inclined upward or downward with respect to a horizontal plane, and an inclination angle $\beta$ of the squirting direction with respect to the horizontal plane is 10° or less.

31. The hot-rolled-strip production system according to claim 20 or 21, further comprising:

a cooling device for supplying cooling water from above to the hot rolled strip conveyed by the hot runout table; and a shielding member provided above the hot runout table to shield the fluid jet squirted from the fluid-squirting nozzle from the cooling water.

32. The hot-rolled-strip production system according to claim 20 or 21, further comprising:

a cooling device for supplying cooling water from above to the hot rolled strip conveyed by the hot runout table; and a shielding-fluid-jet squirting nozzle that squirts, above and substantially parallel to the fluid jet squirted from the fluid-squirting nozzle, a shielding fluid jet for shielding the fluid jet from the cooling water.

* * * * *

UNITED STATES PATENT AND TRADEMARK OFFICE

CERTIFICATE OF CORRECTION

PATENT NO. : 7,448,244 B2
APPLICATION NO. : 10/517170
DATED : November 11, 2008
INVENTOR(S) : Shinichiro Aoe et al.

It is certified that error appears in the above-identified patent and that said Letters Patent is hereby corrected as shown below:

Column 27, line 2;

Change "of α" to --α of--.

Signed and Sealed this

Seventeenth Day of February, 2009

JOHN DOLL
*Acting Director of the United States Patent and Trademark Office*